US009981265B2

(12) United States Patent
Govyadinov et al.

(10) Patent No.: US 9,981,265 B2
(45) Date of Patent: May 29, 2018

(54) MICROFLUIDIC MIXING DEVICE

(71) Applicant: HEWLETT-PACKARD DEVELOPMENT COMPANY, L.P., Houston, TX (US)

(72) Inventors: Alexander Govyadinov, Corvallis, OR (US); Pavel Kornilovich, Corvallis, OR (US); Erik D. Torniainen, Maple Grove, OR (US); David P. Markel, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 150 days.

(21) Appl. No.: 15/134,300

(22) Filed: Apr. 20, 2016

(65) Prior Publication Data

US 2016/0228873 A1 Aug. 11, 2016

Related U.S. Application Data

(63) Continuation of application No. 13/925,309, filed on Jun. 24, 2013, now Pat. No. 9,409,170.

(51) Int. Cl.
*F15D 1/00* (2006.01)
*F15D 1/02* (2006.01)
(Continued)

(52) U.S. Cl.
CPC ..... *B01L 3/502715* (2013.01); *B01F 5/0275* (2013.01); *B01F 5/10* (2013.01);
(Continued)

(58) Field of Classification Search
CPC ..... B01L 2400/0633; B01L 3/502715; B01L 3/502738; B01L 3/50273; B01L 3/502769;
(Continued)

(56) References Cited

U.S. PATENT DOCUMENTS 6,065,864 A 5/2000 Evans et al.
6,858,185 B1 2/2005 Kopf-Sill
(Continued)

FOREIGN PATENT DOCUMENTS

CN 102145265 8/2011
EP 1652575 5/2006
(Continued)

OTHER PUBLICATIONS

Mansur, E. A. et al.; A State-of-the-art Review of Mixing in Microfluidic Mixers; The State Key Laboratory of Chemical Engineering, Department of Chemical Engineering, Tsinghua University, Beijing 100084, China; Aug. 4, 2008.
(Continued)

*Primary Examiner* — Jennifer Wecker
(74) *Attorney, Agent, or Firm* — Fabian VanCott

(57) ABSTRACT

A microfluidic mixing device comprises a main channel and a number of secondary channels extending from a portion of the main channel and entering another portion of the main channel. A number of actuators are located in the secondary channels to pump fluids through the secondary channels. A microfluidic mixing system comprises a microfluidic mixing device. The microfluidic mixing device comprises a main fluid mixing channel, a number of main channel actuators to pump fluid through the main fluid mixing channel, a number of secondary channels fluidly coupled to the main fluid mixing channel, and a number of secondary channel actuators to pump fluids through the secondary channels. The microfluidic mixing device also comprises a fluid source, and a control device to provide fluids from the fluid source to the microfluidic mixing device and activate the main channel actuators and secondary channel actuators.

20 Claims, 15 Drawing Sheets

(51) Int. Cl.

| | |
|---|---|
| ***B01L 3/00*** | (2006.01) |
| ***B01F 13/00*** | (2006.01) |
| ***B01F 5/02*** | (2006.01) |
| ***B01F 5/10*** | (2006.01) |
| *B01F 5/00* | (2006.01) |
| *F01D 1/00* | (2006.01) |
| *F01D 3/00* | (2006.01) |

(52) U.S. Cl.
CPC ..... *B01F 13/0059* (2013.01); *B01L 3/50273* (2013.01); *B01L 3/502738* (2013.01); *B01L 3/502769* (2013.01); *B01L 2200/0636* (2013.01); *B01L 2300/088* (2013.01); *B01L 2300/0816* (2013.01); *B01L 2300/0861* (2013.01); *B01L 2300/0867* (2013.01); *B01L 2400/043* (2013.01); *B01L 2400/0406* (2013.01); *B01L 2400/0415* (2013.01); *B01L 2400/0433* (2013.01); *B01L 2400/0439* (2013.01); *B01L 2400/0442* (2013.01); *B01L 2400/0478* (2013.01); *B01L 2400/0633* (2013.01); *F01D 1/00* (2013.01); *F01D 3/00* (2013.01)

(58) Field of Classification Search
CPC ..... B01L 2300/0867; B01L 2300/0861; B01L 2300/088; B01L 2400/0406; B01L 2400/043; B01L 2200/0636; B01L 2400/0478; B01L 2300/0816; B01L 2400/0415; B01L 2400/0433; B01L 2400/0442; F01D 1/00; F01D 3/00; B01F 5/0275; B01F 5/10
See application file for complete search history.

(56) References Cited

U.S. PATENT DOCUMENTS

| | | | | |
|---|---|---|---|---|
| 7,763,453 | B2 | 7/2010 | Clemmens et al. | |
| 8,157,434 | B2 | 4/2012 | Cohen et al. | |
| 8,210,209 | B2 | 7/2012 | Gilbert et al. | |
| 8,277,112 | B2 | 10/2012 | Bhopte | |
| 8,696,898 | B2 | 4/2014 | Meese | |
| 9,211,539 | B2 | 12/2015 | Amin et al. | |
| 2008/0259720 | A1 | 10/2008 | Lam et al. | |
| 2008/0316854 | A1 | 12/2008 | Wang et al. | |
| 2009/0087859 | A1 | 4/2009 | Johnson | |
| 2011/0286493 | A1 | 11/2011 | Torniainen et al. | |
| 2012/0070833 | A1 | 3/2012 | Wang | |
| 2012/0136492 | A1* | 5/2012 | Amin | B01F 5/102 700/285 |
| 2012/0244604 | A1 | 9/2012 | Kornilovich et al. | |
| 2012/0300576 | A1 | 11/2012 | Li et al. | |
| 2013/0164854 | A1 | 6/2013 | Wang et al. | |
| 2013/0344617 | A1 | 12/2013 | Robertson | |
| 2014/0134623 | A1* | 5/2014 | Hiddessen | G01N 1/38 435/6.12 |
| 2014/0377145 | A1 | 12/2014 | Govyadinov et al. | |
| 2015/0190767 | A1 | 7/2015 | Govyadinov et al. | |

FOREIGN PATENT DOCUMENTS

| | | |
|---|---|---|
| RU | 2403962 | 11/2010 |
| WO | WO-2009118689 | 10/2009 |
| WO | WO-2012154688 | 11/2012 |

OTHER PUBLICATIONS

Tsai, H. et al., Active Microfluidic Mixer and Gas Bubble Filter Driven by Thermal Bubble Micropump, Apr. 1, 2002, < http://www.me.berkeley.edu/~lwlin/papers/jhtsaiS%26A.pdf>.

* cited by examiner

MICROFLUIDIC MIXING DEVICE

BACKGROUND

The ability to mix fluids at microscale may be applied in a variety of industries, such as printing, food, biological, pharmaceutical, and chemical industries. Microfluidic mixing devices may be used within these industries to provide miniaturized environments that facilitate the mixing of very small sample volumes such as in chemical synthesis, biomedical diagnostics, drug development, and DNA replication. Microfabrication techniques enable the fabrication of small-scale microfluidic mixing devices on a chip. Enhancing the efficiency of such microfluidic mixing devices is beneficial for increasing the throughput and reducing the cost of various microfluidic systems, such as bio-chemical micro reactors and lab-on-chip systems.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
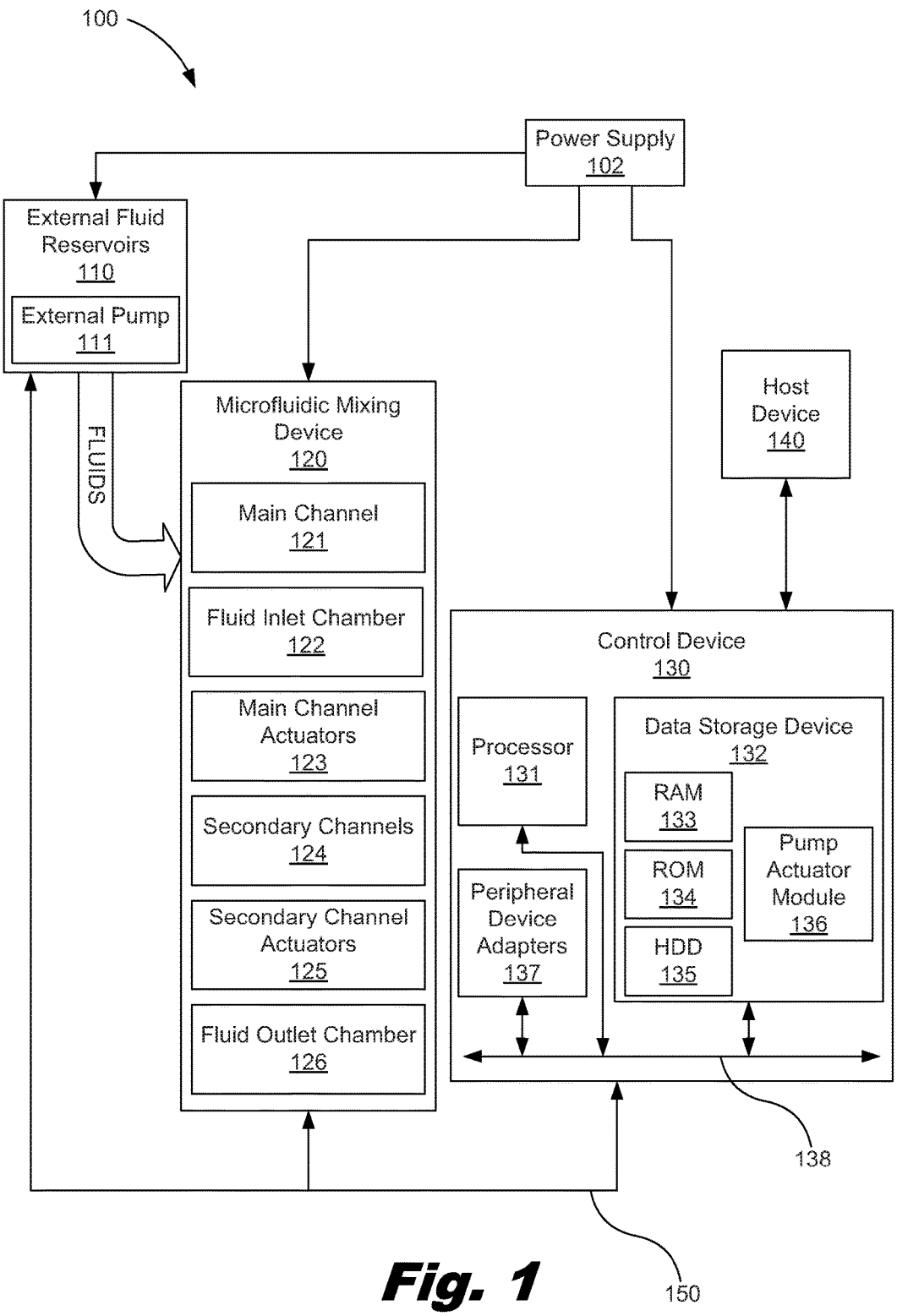
FIG. 1 is a block diagram of a microfluidic mixing system, according to one example of the principles described herein.

Microfluidic mixing devices operate in a laminar flow regime that use diffusive species mixing. Diffusive mixing is slow and relies on nonzero diffusivity of the mixing components, and may use long mixing periods with large fluidic paths and volumes. For example, passive mixing devices provide increased contact areas and contact times between the components being mixed, and have complicated three dimensional geometries, occupy large areas of the microfluidic system, are difficult to fabricate, and have large associated pressure losses across the mixing element and microfluidic system. Such mixers also use large volumes of mixing fluids which results in considerable dead/parasitic volumes within the microfluidic system.

Active mixing devices improve mixing performance by providing forces that speed up the diffusion process between the components being mixed. Active mixing devices may use a mechanical transducer that agitates the fluid components to improve mixing.

However, even with the introduction of various passive and active mixing devices within a microfluidic mixing device, a microfluidic mixing device may not provide for as complete and fast enough mixture of the fluids introduced into the microfluidic mixing device because such devices may not provide enough displacement or transverse flows within the microfluidic mixing device. Thus, the present disclosure describes systems and methods for mixing fluids within a microfluidic mixing device that uses a number of secondary channels that extend from a main channel of a microfluidic mixing device. The secondary channels comprise secondary channel actuators located within the secondary channels that assist in the movement of fluids through the secondary channels in order to create additional and more effective instances of displacement and transverse flows within the fluids introduced into the microfluidic mixing device for mixing.

As used in the present specification and in the appended claims, the term "fluid" is meant to be understood broadly as any substance, such as, for example, a liquid, that is capable of flowing and that changes its shape at a steady rate when acted upon by a force tending to change its shape. In one example, any number of fluids may be mixed within the microfluidic mixing devices described herein to obtain a mixed fluid comprising portions of the fluids introduced into the microfluidic mixing devices. In one example, the fluids mixed in the microfluidic devices may comprise two or more fluids, fluids comprising pigments or particles within a single host fluid, or combinations thereof.

Further, as used in the present specification and in the appended claims, the term "transverse flow" is meant to be understood broadly as two or more flows of fluids whose directions are non-parallel. The flows may be angled relative to each other at acute angles, obtuse angles, 90° angles, directly opposite each other at 180°, or any angle there between. Fluids flowing in a non-parallel manner experience a number of instances of mixing and amalgamation.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1 is a block diagram of a microfluidic mixing system (100), according to one example of the principles described herein. The microfluidic mixing system (100) implements the mixing of fluids through a microfluidic mixing device (120) and processor-implemented mixing methods, as disclosed herein. The microfluidic mixing system (100) comprises a number of external fluid reservoirs (110) to supply fluidic components/samples, solutions, or a combination thereof, to the mixing device (120) for mixing. In one example, the microfluidic mixing system (100) may comprise an external pump (111) as part of the external fluid reservoirs (110), or as a standalone pump fluidly coupled to the external fluid reservoirs (110). The microfluidic mixing device (120) comprises a main channel (121), a fluid inlet chamber (122), a number of main channel actuators (123), a number of secondary channels (124), a number of secondary channel actuators (125), and a fluid outlet chamber (126). The fluid inlet chamber (122), main channel actuators (123), and a fluid outlet chamber (126), in some examples, may be optional elements. The main channel (121), fluid inlet chamber (122), main channel actuators (123), secondary channels (124), secondary channel actuators (125), and fluid outlet chamber (126) will be described in more detail below.

In one example, the microfluidic mixing device (120) and its elements may be implemented as a chipbased mixing device that comprises the main microfluidic mixing channel (121) for mixing two or more fluids as the fluids flow through the main channel (121), for mixing pigments or particles within a single host fluid as the host fluid flows through the main channel (121), or combinations thereof. The structures and components of the chip-based microfluidic mixing device (120) may be fabricated using a number of integrated circuit microfabrication techniques such as electroforming, laser ablation, anisotropic etching, sputtering, dry and wet etching, photolithography, casting, molding, stamping, machining, spin coating, laminating, among others, and combinations thereof.

The microfluidic mixing system (100) also comprises a control device (130) to control various components and functions of the system (100), such as the microfluidic mixing device (120), the external fluid reservoir(s) (110), and the external pump (111). In one example, control device (130) controls various functions of the microfluidic mixing device (120) that comprise the sequence and timing of activation for actuators within the mixing device (120) to mix fluid within the mixing device (120) and to move fluid through the mixing device (120). In another example, the control device (130) controls various functions of the external fluid reservoirs (110) and external pump (111) to introduce a number of fluids into the microfluidic mixing device (120).

To achieve its desired functionality, the control device (130) comprises various hardware components. Among these hardware components may be a processor (131), a data storage device (132), a number of peripheral device adapters (137), and other devices for communicating with and controlling components and functions of microfluidic mixing device (120), external fluid reservoirs (110), external pump (111), and other components of microfluidic mixing system (100). These hardware components may be interconnected through the use of a number of busses and/or network connections. In one example, the processor (131), data storage device (132), peripheral device adapters (137) may be communicatively coupled via bus (138).

The processor (131) may comprise the hardware architecture to retrieve executable code from the data storage device (132) and execute the executable code. The executable code may, when executed by the processor (131), cause the processor (131) to implement at least the functionality of controls various functions of the microfluidic mixing device (120), according to the methods of the present specification described herein. In the course of executing code, the processor (131) may receive input from and provide output to a number of the remaining hardware units.

The data storage device (132) may store data such as executable program code that is executed by the processor (131) or other processing device. As will be discussed, the data storage device (132) may specifically store a number of applications that the processor (131) executes to implement at least the functionality described herein. The data storage device (132) may comprise various types of memory modules, including volatile and nonvolatile memory. For example, the data storage device (132) of the present example comprises Random Access Memory (RAM) (133), Read Only Memory (ROM) (134), flash solid state drive (SSD), and Hard Disk Drive (HDD) memory (135). Many other types of memory may also be utilized, and the present specification contemplates the use of many varying type(s) of memory in the data storage device (132) as may suit a particular application of the principles described herein. In certain examples, different types of memory in the data storage device (132) may be used for different data storage needs. For example, in certain examples the processor (131) may boot from Read Only Memory (ROM) (134), maintain nonvolatile storage in the Hard Disk Drive (HDD) memory (135), and execute program code stored in Random Access Memory (RAM) (133).

In this manner, the control device (136) comprises a programmable device that comprises machine-readable or machine usable instructions stored in the data storage device (132), and executable on the processor (131) to control mixing and pumping processes on the microfluidic mixing device (120). Such modules may comprise, for example, a pump actuator module (136) to implement sequence and timing instructions.

In one example, the control device (130) may receive data from a host device (140), such as a computer, and temporarily store the data in the data storage device (132). The data from the host (140) represents, for example, executable instructions and parameters for use alone or in conjunction with other executable instructions in other modules stored in the data storage device (132) of the control device (130) to control fluid flow, fluid mixing, and other fluid mixing related functions within the microfluidic mixing device (120). For example, the data executable by processor (131) of the control device (130) may enable selective and controlled activation of a number of micro-inertial actuators (FIG. 1, 123, 125) within the microfluidic mixing device (120) through precise control of the sequence, timing, frequency and duration of fluid displacements generated by the actuators (FIG. 1, 123, 125). Modifiable (i.e., programmable) control over the actuators (FIG. 1, 123, 125) via the data and actuator sequence and timing instructions enables any number of different mixing process protocols to be performed on different implementations of the microfluidic mixing device (120) within the microfluidic mixing system (100). In one example, mixing protocols may be adjusted on-the-fly for a given microfluidic mixing device (120).

The microfluidic mixing system (100) may also comprise a number of power supplies (102) to provide power to the microfluidic mixing device (120), the control device (130), the external fluidic reservoirs (110), the external pump (110), and other electrical components that may be part of the microfluidic mixing system (100).

Figure 2A:
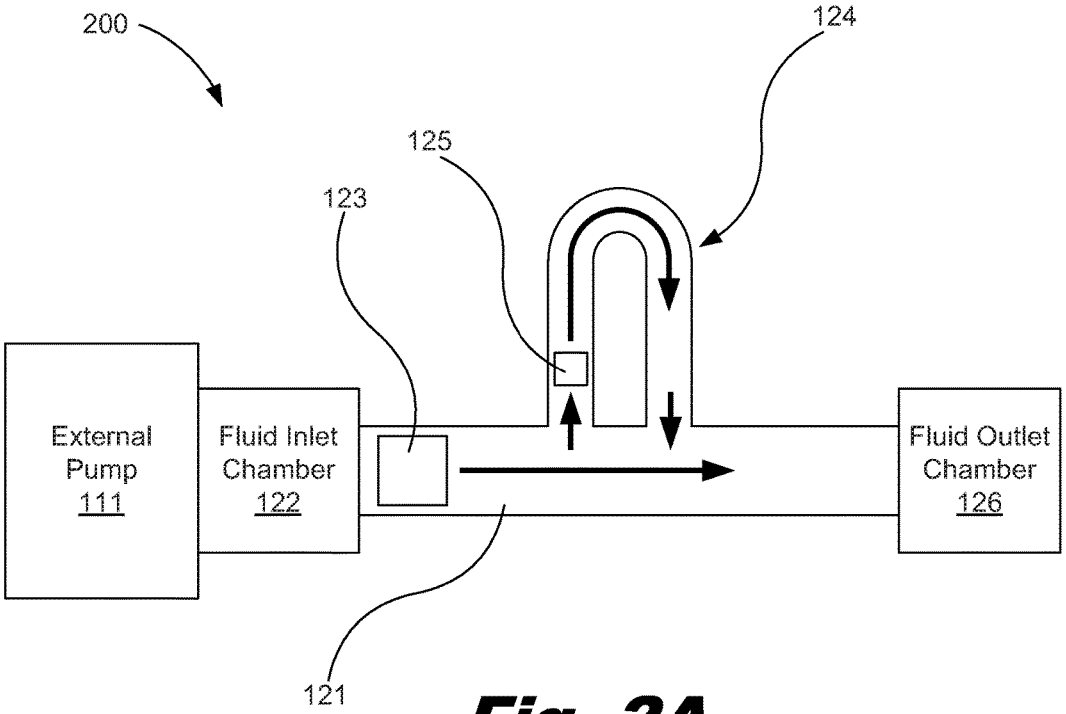
FIG. 2A is a cross-sectional diagram of an inflow microfluidic mixing device, according to one example of the principles described herein.
Figure 2B:
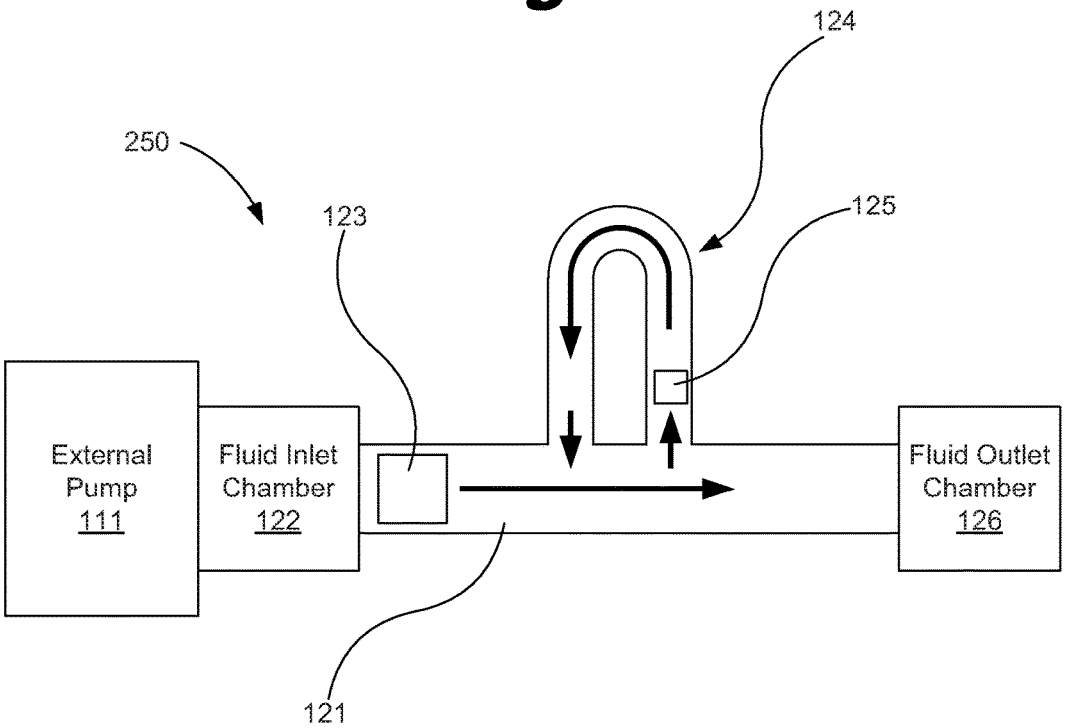
FIG. 2B is a cross-sectional diagram of a counterflow microfluidic mixing device, according to one example of the principles described herein.

FIG. 2A is a cross-sectional diagram of an inflow microfluidic mixing device (200), according to one example of the principles described herein. FIG. 2B is a cross-sectional diagram of a counterflow microfluidic mixing device (250), according to one example of the principles described herein. When referring to elements or characteristics of a microfluidic mixing device that may be present in various examples described herein, reference to the microfluidic mixing device (120) of FIG. 1 will be made. However, any elements that may be described in connection with any example of a microfluidic mixing device may also be applied to other examples of microfluidic mixing devices.

Throughout FIGS. 2A through 13B, arrows indicating direction of flow are depicted. In some examples, arrows indicating the flow of fluids through the microfluidic mixing device (FIG. 1, 120) may be depicted as being relatively larger or smaller than other arrows. The larger arrows indicate a greater force exerted by the external pump (111) or secondary channel actuators (125) as the case may be. These discrepancies in forces or pressures exerted cause the fluids within the microfluidic mixing device (FIG. 1, 120) to flow differently as will be described in more detail below. Further, although the flow of fluids through the main channel (FIG. 1, 121) may or may not be described, all microfluidic mixing devices (FIG. 1, 120) described herein comprise a flow within the main channel (FIG. 1, 121) that interacts with flows present in a number of secondary channels (FIG. 1, 124). The flows within the main channel (FIG. 1, 121) are transverse to a number of flows created by the secondary channels (FIG. 1, 124), and, in this manner, the fluids introduced into the microfluidic mixing devices (FIG. 1, 120) are amalgamated.

The example microfluidic mixing devices (200, 250) of FIGS. 2A and 2B may comprise an external pump (111). In examples of microfluidic mixing systems (FIG. 1, 100) or microfluidic mixing devices (120) disclosed herein where an external pump (111) is used, the external pump (111) fluidly couples the external fluid reservoirs (FIG. 1, 110) with the main channels (121) of the microfluidic mixing devices (FIG. 1, 120) in order to supply the fluid to the microfluidic mixing devices (120) for mixing. In one example, the microfluidic mixing devices (FIG. 1, 120) may not comprise an external pump (111).

The example microfluidic mixing devices (200, 250) of FIGS. 2A and 2B may comprise a main channel (121) fluidly coupled to the external pump (111). The main channel (121) assists in the mixing of the fluids that are introduced into the microfluidic mixing devices (200, 250) by providing a pathway in which the fluids can mix as they flow through the main channel (121). In one example, the shape of main channel (121) may comprise other shapes such as curved shapes, snake-like shapes, shapes with 90 degree corners, shapes with corners having acute angles, shapes with corners having obtuse angles, among other shapes, and combinations thereof. The shape of the main channel (121) may depend on the process by which the microfluidic mixing devices (FIG. 1, 120) are made, and the application for which the microfluidic mixing devices (FIG. 1, 120) are used, among other parameters.

Fluids entering the main channel (121) pass into the main channel (121) from a fluid inlet chamber (122). Any number of separate portions of fluids may be introduced into the main channel (121) through fluid inlet chamber (122) for mixing. In one example, two separate portions of fluids may be introduced into the main channel (121). In another example, more than two separate portions of fluids may be introduced into the main channel (121). In another example, a single host fluid may be introduced into the main channel (121) in which the host fluid comprises pigments, particles, or combinations thereof that are to be mixed within the single host fluid by the microfluidic mixing device (FIG. 1, 120).

A number of main channel actuators (123) may be positioned within the main channel (121). In one example, the main channel actuators (123) may be axis-asymmetric actuators; main channel actuators (123) integrated within the main channel (121) at a location that is on one side or the other of the center line, or center axis, that runs the length of the main channel (121). In another example, the main channel actuators (123) may be axis-symmetric actuators; main channel actuators (123) integrated within the main channel (121) at a location that is substantially on the center axis that runs the length of the main channel (121). In still another example, the main channel actuators (123) may be a combination of axis-asymmetric and axis-symmetric actuators. The main channel actuators (123) may be located anywhere along the length of the main channel (121).

The main channel actuators (123) are any device that, when instructed by the control device (130), create a number of displacements and transverse flows within the main channel (121) of the microfluidic mixing device (120) that cause amalgamation to occur between the fluids. These displacements or transverse flows mix the fluids introduced into the microfluidic mixing device (120) to create a mixture with a desired level of homogeneity and heterogeneity. In one example, the main channel actuators (123) may be any of a number of types of fluidic inertial pump actuators. In one example, the main channel actuators (123) may be implemented as thermal resistors that produce steam bubbles to create fluid displacement within the main channel (121). In another example, the main channel actuators (123) may also be implemented as piezo elements, such as, for example, lead zirconium titanate-based (PZT) elements whose electrically induced deflections generate fluid displacements within the main channel (121). Other deflective membrane elements activated by electrical, magnetic, mechanical, and other forces may also be used in implementing the functionality of the main channel actuators (123).

In another example, the main channel actuators (123) may be active mixing devices that provide forces that speed up the amalgamation process between the fluids introduced into the microfluidic mixing device (FIG. 1, 120) to be mixed. The active mixing devices may employ a mechanical transducer that agitates the fluid components to improve mixing. Examples of transducers used in active mixers include acoustic or ultrasonic, dielectrophoretic, electrokinetic timepulse, pressure perturbation, and magnetic transducers.

The example microfluidic mixing devices (200, 250) of FIGS. 2A and 2B may comprise a number of secondary channels (124) through which the number of fluids introduced into the main channel (121) may flow in order to assist in the mixing of the fluids within the microfluidic mixing devices (200, 250). Although only one secondary channel (124) is depicted in FIGS. 2A and 2B, any number of secondary channels (124) may be integrated into the microfluidic mixing devices (FIG. 1, 120) described herein as will be described in more detail below.

In one example, the secondary channels (124) of the microfluidic mixing devices (FIG. 1, 120) described herein comprise a u-shape appendage that extends from the main channel (121). The u-shaped secondary channels (124) provide for a channel in which the fluids introduced into the main channel (121) may be drawn from the main channel (121) via a first leg of the u-shaped appendage of the secondary channel, and reintroduced into the main channel (121) via a second leg of the u-shaped appendage. Movement of the fluids through the secondary channels (124) provides for additional instances in which the fluids experience a number of transverse flows within the main channel (121) of the microfluidic mixing device (FIG. 1, 120) and displacement with respect to other fluids. In this manner, the number of fluids introduced into the microfluidic mixing device (FIG. 1, 120) are mixed and amalgamated.

A number of secondary channel actuators (125) may be positioned within the secondary channels (124) to assist in the movement of fluids from the main channel (121), through the secondary channels (124), back into the main channel (121), and combinations of these fluid movements. In one example, the secondary channel actuators (125) may be axis-asymmetric actuators; secondary channel actuators (125) integrated within the secondary channels (124) at a location that is on one side or the other of a center axis that runs the length of the secondary channel (124). In another example, the secondary channel actuators (125) may be axis-symmetric actuators; secondary channel actuators (125) integrated within the secondary channel (124) at a location that is substantially on the center axis that runs the length of the secondary channels (124). In still another example, the secondary channel actuators (125) may be a combination of axis-asymmetric and axis-symmetric actuators. The secondary channel actuators (125) may be located anywhere along the length of the secondary channels (124).

The secondary channel actuators (125) are any device that, when instructed by the control device (130), moves the fluid through the secondary channels (124). The secondary channel actuators (125) may also be instructed to create a number of transverse flows within the secondary channels (124) of the microfluidic mixing devices (120). These displacements or transverse flows mix the fluids introduced into the microfluidic mixing device (120) to create a mixture with a desired level of homogeneity and heterogeneity. In one example, the secondary channel actuators (125) may be any of a number of types of fluidic inertial pump actuators. In one example, the secondary channel actuators (125) may be implemented as thermal resistors that produce steam bubbles to create fluid displacement within the secondary channels (124). In another example, the secondary channel actuators (125) may also be implemented as piezo elements, such as, for example, lead zirconium titanate-based (PZT) elements whose electrically induced deflections generate fluid displacements within the secondary channels (124). Other deflective membrane elements activated by electrical, magnetic, mechanical, and other forces may also be used in implementing the functionality of the secondary channel actuators (125).

In another example, the secondary channel actuators (125) may be active mixing devices that provide forces that speed up the amalgamation process between the fluids introduced into the microfluidic mixing device (FIG. 1, 120) to be mixed. The active mixing devices may employ a mechanical transducer that agitates the fluid components to improve mixing. Examples of transducers used in active mixers include acoustic or ultrasonic, dielectrophoretic, electrokinetic timepulse, pressure perturbation, and magnetic transducers.

The example microfluidic mixing devices (200, 250) of FIGS. 2A and 2B may comprise a fluid outlet chamber (126) into which the fluids, in a mixed state, are received as the fluids exit the main channel (121) of the microfluidic mixing device (200). In one example, the fluid outlet chamber (126) is implemented in a number of ways, such as, for example, a reservoir, as another fluidic channel, and as a reservoir with a number of coupled fluidic channels, among others.

A number of arrows are depicted within the main channel (121) and secondary channel (124) of the microfluidic mixing devices (200, 250). The arrows indicate the direction of the flow of the fluids within the main channel (121) and secondary channel (124). The microfluidic mixing device (200) of FIG. 2A, being an inflow microfluidic mixing device (200), uses the secondary channel actuators (125) to cause the fluids to move from the main channel (121), into the secondary channel (124), and back into the main channel (121) in the same direction as the direction of flow within the main channel (121). Thus, while in the secondary channel (124), the fluids move either approximately perpendicularly to or in the same direction as the flow of fluids in the main channel (121) as indicated by the arrows.

In contrast, the microfluidic mixing device (250) of FIG. 2B is a counterflow microfluidic mixing device. In the example of FIG. 2B, the flow of fluids through the secondary channel (124) is, at one point, in a direction opposite the flow of the fluids within the main channel (121). In this example, the microfluidic mixing device (250) uses the secondary channel actuators (125) to cause the fluids to move from the main channel (121), into the secondary channel (124), and back into the main channel (121) in the opposite direction as the direction of flow within the main channel (121). Thus, while in the secondary channel (124), the fluids move either approximately perpendicularly to or in the opposite direction as the flow of fluids in the main channel (121) as indicated by the arrows.

In the examples of FIGS. 2A and 2B, and throughout the examples described herein, any number of secondary channel actuators (125) may be located within the secondary channels (124). In the examples of FIGS. 2A and 2B, the secondary channel actuators (125) are located in an arm of the secondary channel (124) through which the fluids first enter the secondary channels (124). However, the location of the secondary channel actuators (125) may vary based on, for example, the number and implementation of the secondary channel actuators (125) within the secondary channels.

The main channel actuators (123) and secondary channel actuators (125) in the examples of FIGS. 2A and 2B, and throughout the examples described herein, are actuated by the control device (130) via an electrical connection (FIG. 1, 150). As described above, the control device (130) controls various components and functions of the system (100). This includes various functions of the microfluidic mixing device (120) including the sequence and timing of activation for actuators within the mixing device (120) to mix fluid within the mixing device (120) and to move fluid through the mixing device (120). In this manner, various fluid flows may be moved through the main channel (121) and the secondary channels (124) such that the fluids mix. A number of various arrangements of elements within a microfluidic mixing device will now be described in connection with FIGS. 3A through 14.

Figure 3A:
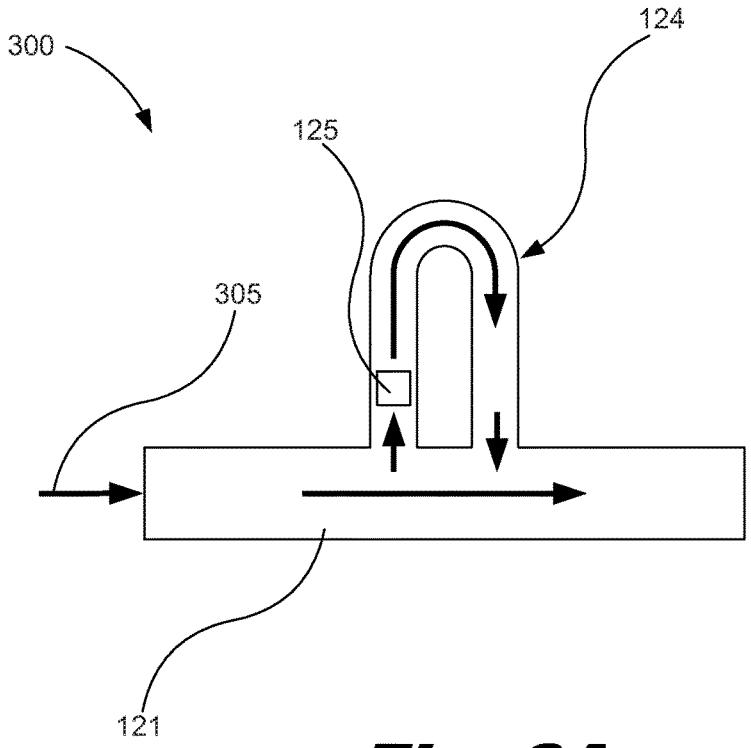
FIG. 3A is a cross-sectional diagram of an inflow microfluidic mixing device with an external pump, according to one example of the principles described herein.
Figure 3B:
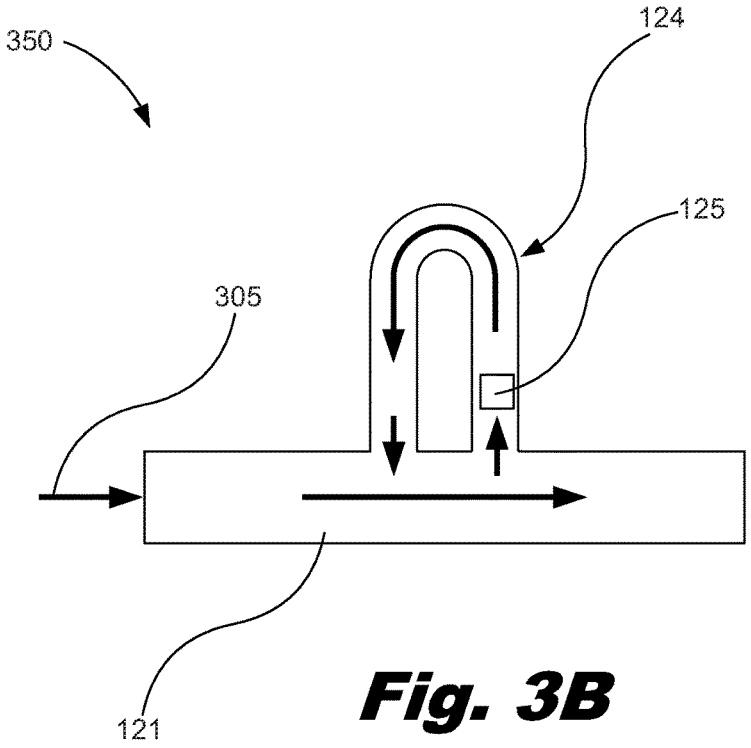
FIG. 3B is a cross-sectional diagram of a counterflow microfluidic mixing device with an external pump, according to one example of the principles described herein.

FIG. 3A is a cross-sectional diagram of an inflow microfluidic mixing device (300) with an external pump (FIG. 1, 111), according to one example of the principles described herein. FIG. 3B is a cross-sectional diagram of a counterflow microfluidic mixing device (350) with an external pump (FIG. 1, 111), according to one example of the principles described herein. Arrows 305 in FIGS. 3A and 3B indicate the influence of the external pump (FIG. 1, 111) on the flow of fluids through the main channels (121), and, indirectly, through the secondary channels (124). As the external pump (FIG. 1, 111) moves fluid through the main channel (121) of the microfluidic mixing devices (300, 350), the secondary channel actuators (125) draw the fluids into the secondary channels (124), and introduced the fluids back into the main channel (121). In this manner, the fluids experience a number of transverse flows within the microfluidic mixing devices (300, 350), amalgamating the fluids.

Figure 4A:
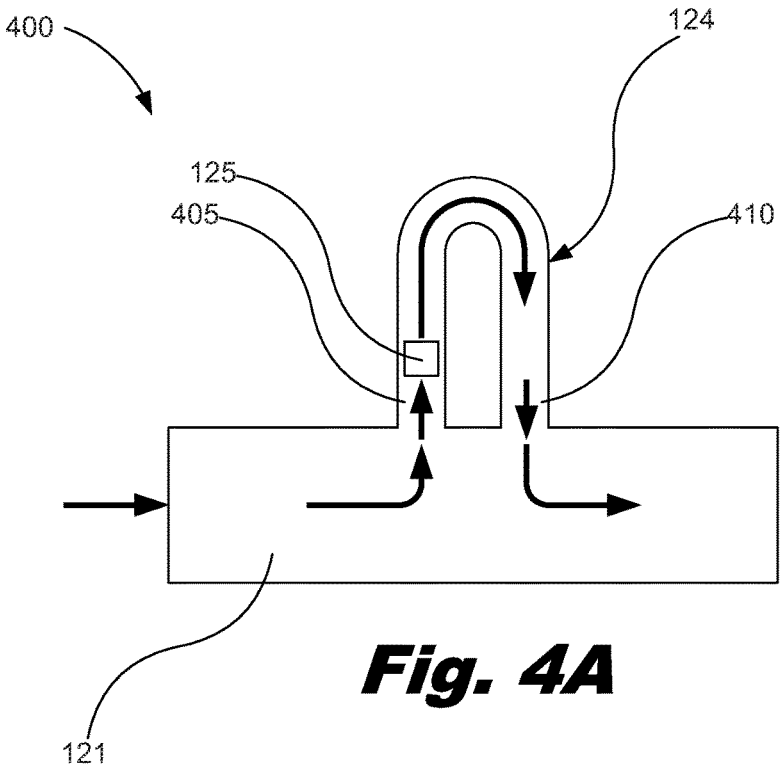
FIG. 4A is a cross-sectional diagram of an inflow microfluidic mixing device in which the secondary channel actuator produces an approximately omega-shaped (Ω) flow through the microfluidic mixing device, according to one example of the principles described herein.
Figure 4B:
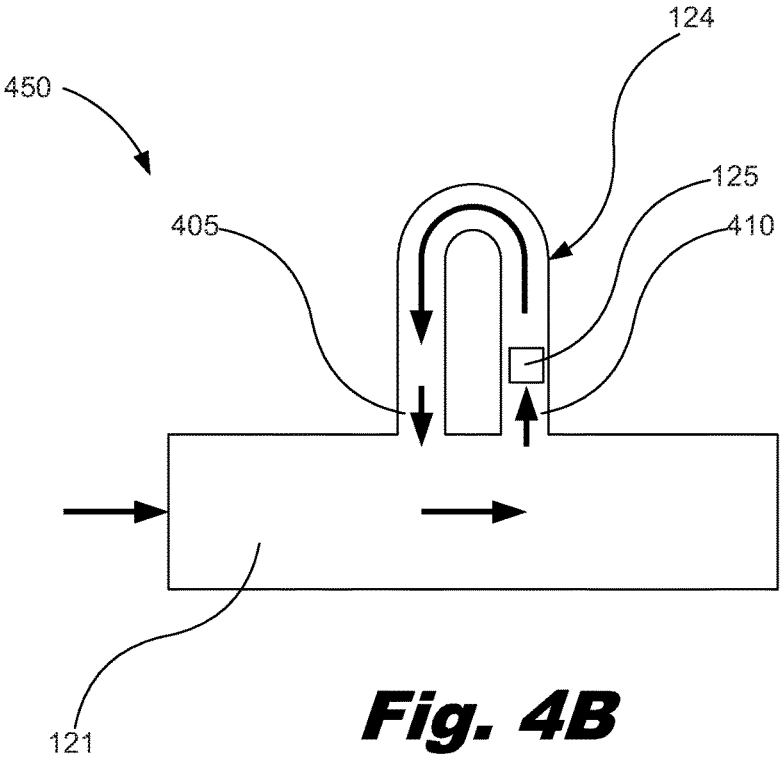
FIG. 4B is a cross-sectional diagram of an inflow microfluidic mixing device in which the secondary channel actuator produces an o-shaped (O) flow through the microfluidic mixing device, according to one example of the principles described herein.

FIG. 4A is a cross-sectional diagram of an inflow microfluidic mixing device (400) in which the secondary channel actuator (125) produces an approximately omega-shaped (Ω) flow through the microfluidic mixing device, according to one example of the principles described herein. FIG. 4B is a cross-sectional diagram of an inflow microfluidic mixing device in which the secondary channel actuator (125) produces an o-shaped (O) flow through the microfluidic mixing device, according to one example of the principles described herein. As to FIG. 4A, the flow throughout the main channel (121) and secondary channel (124), as indicated by the arrows, creates an approximately omega-shaped (Ω) flow through the microfluidic mixing device (400). The secondary channel actuator (125) in the secondary channel (124) of FIG. 4A draws fluids from the main channel (121) into a first leg (405) of the secondary channel (124), pushes the fluids through the curved portion of the u-shaped secondary channel (124), and reintroduces the fluids into the main channel (121) via the second leg (410) of the secondary channel (124). This flow forms an approximate omega-shape (Ω).

In addition to the approximately omega-shaped (Ω) flow through the microfluidic mixing device (400), the flow produced by the external pump (FIG. 1, 111) is approximately equal to the omega-shaped (Q) flow as indicated by the size of the arrows. In this example, the external pump (FIG. 1, 111) and the secondary channel actuator (125) are controlled by the control device (130) so that the pressures exerted by the two devices are approximately equal. Providing for equal pressures to exist within the main channel (121) and the secondary channel (124) provide for good mixing at a low flow rate as compared to other examples described herein. Thus, the example of FIG. 4A may be employed in mixing fluids in which good mixing is a goal, but fast flow rate is not an objective.

As to FIG. 4B, the flow throughout the main channel (121) and secondary channel (124) as indicated by the arrows creates an o-shaped (O) flow through the microfluidic mixing device (450). The secondary channel actuator (125) in the secondary channel (124) of FIG. 4B draws fluids from the main channel into a second leg (410) of the secondary channel (124), pushes the fluids through the curved portion of the u-shaped secondary channel (124), and reintroduces the fluids into the main channel (121) via the first leg (405) of the secondary channel (124). This flow forms an o-shape (O).

In addition to the o-shaped (O) flow through the microfluidic mixing device (450), the flow produced by the external pump (FIG. 1, 111) is approximately equal to the o-shaped (O) flow as indicated by the size of the arrows. In this example, the external pump (FIG. 1, 111) and the secondary channel actuator (125) are controlled by the control device (130) so that the pressures exerted by the two devices are approximately equal. Providing for equal pressures to exist within the main channel (121) and the secondary channel (124) provide for good mixing at a low flow rate as compared to other examples described herein. Thus, the example of FIG. 4B may be employed in mixing fluids in which good mixing is a goal, but fast flow rate is not an objective.

Figure 5A:
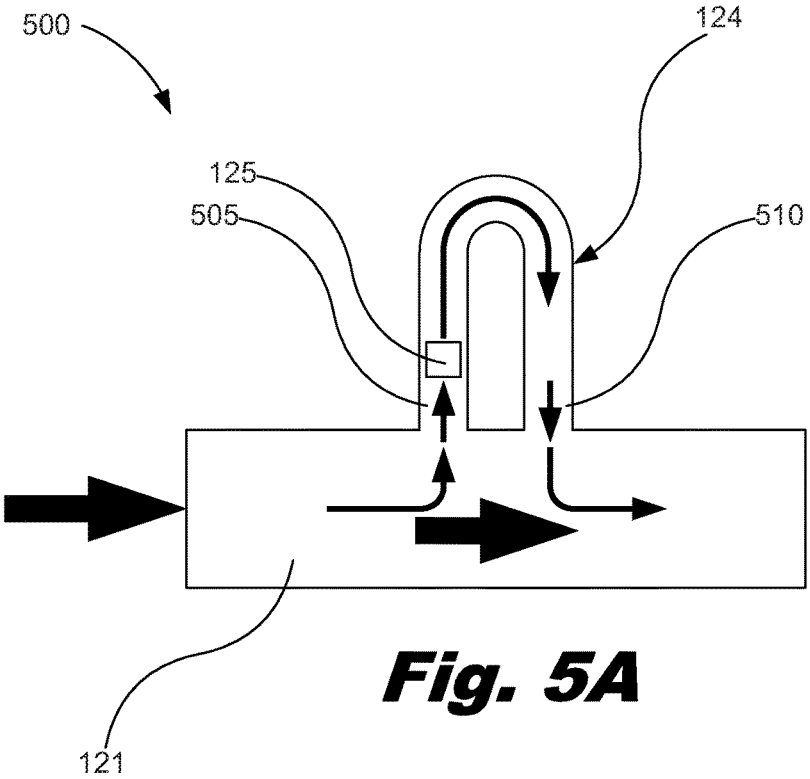
FIG. 5A is a cross-sectional diagram of a parallel flow microfluidic mixing device in which the secondary channel actuator produces an approximately omega-shaped (Ω) flow through the microfluidic mixing device, according to one example of the principles described herein.
Figure 5B:
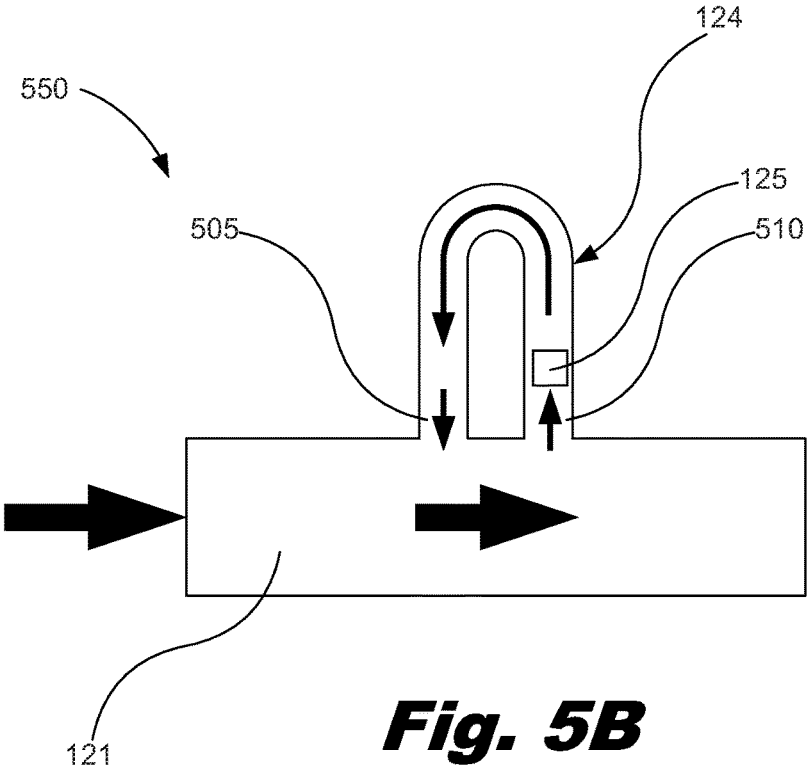
FIG. 5B is a cross-sectional diagram of a counter-flow microfluidic mixing device in which the secondary channel actuator produces an o-shaped (O) flow through the microfluidic mixing device, according to one example of the principles described herein.
Figure 6A:
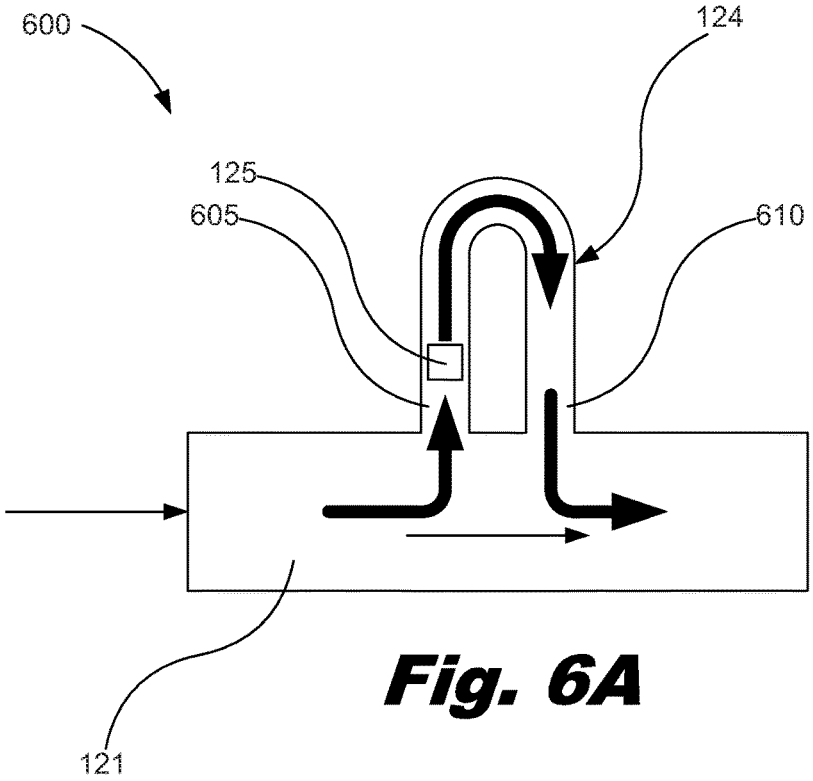
FIG. 6A is a cross-sectional diagram of a parallel flow microfluidic mixing device in which the secondary channel actuator produces an approximately omega-shaped (Ω) flow through the microfluidic mixing device, according to one example of the principles described herein.
Figure 6B:
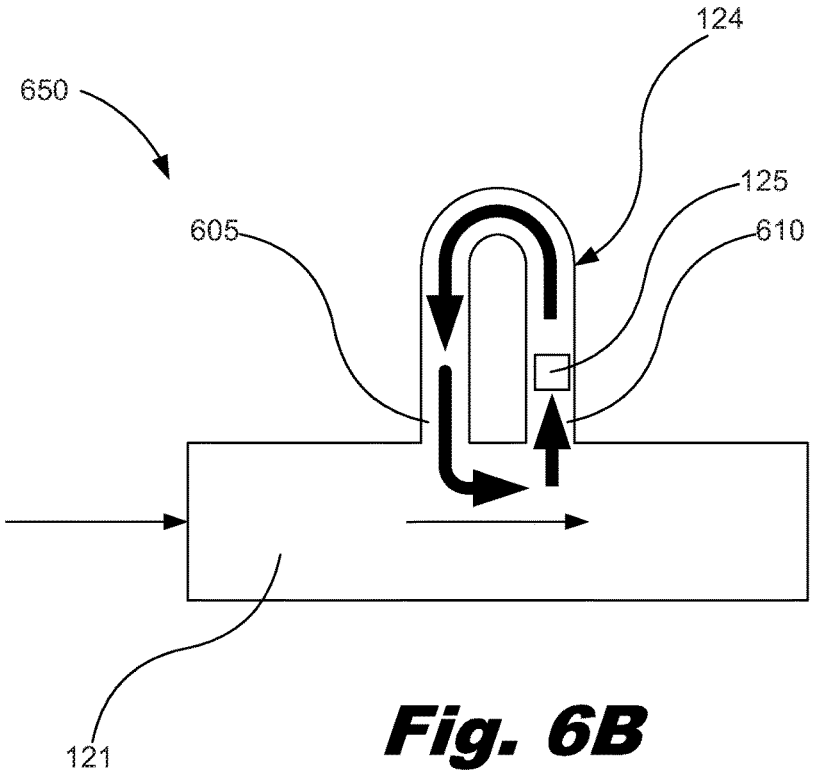
FIG. 6B is a cross-sectional diagram of a counter-flow microfluidic mixing device in which the secondary channel actuator produces an o-shaped (O) flow through the microfluidic mixing device, according to one example of the principles described herein.

FIG. 5A is a cross-sectional diagram of a parallel flow microfluidic mixing device (500) in which the secondary channel actuator produces an approximately omega-shaped (Ω) flow through the microfluidic mixing device, according to one example of the principles described herein. FIG. 5B is a cross-sectional diagram of a counter-flow microfluidic mixing device (550) in which the secondary channel actuator produces an o-shaped (O) flow through the microfluidic mixing device, according to one example of the principles described herein. As to FIG. 5A, the flow throughout the main channel (121) and secondary channel (124) as indicated by the arrows creates an approximately omega-shaped (Ω) flow through the secondary channel (124) of the microfluidic mixing device (500). The secondary channel actuator (125) in the secondary channel (124) of FIG. 5A draws fluids from the main channel (121) into a first leg (505) of the secondary channel (124), pushes the fluids through the curved portion of the u-shaped secondary channel (124), and reintroduces the fluids into the main channel (121) via the second leg (510) of the secondary channel (124). This flow through the secondary channel (124) forms an approximate omega-shape (Ω). Fluids flow within the main channel (121) as well. The fluids flowing in the main channel (121) mix with the fluids flowing through and exiting the secondary channel (124), and amalgamate the fluids. To achieve high mixing efficiency, in one example, fluid flow in secondary channels (124) may be higher or comparable with fluid flow in the main channel (121). This example is represented in FIGS. 6A and 6B, where fluid flow in main channel (FIG. 1, 121) is significantly lower or comparable with flow in secondary channel (FIG. 1, 121) produced by actuators (FIG. 1, 125). When fluidic flow in the main channel (FIG. 1, 121) exceeds the flow in one of a number of secondary channels (FIG. 1, 124), a cascade of the secondary mixing channels (FIG. 1, 124) may be introduced to deliver improved mixing of externally pumped fluids though the main channel (FIG. 1, 121). Examples of this cascaded design addressing enhanced mixing are shown in FIGS. 7 through 11.

In addition to the omega-shaped (Ω) flow through the microfluidic mixing device (500), the flow produced by the external pump (FIG. 1, 111) is relatively greater than the omega-shaped (Ω) flow within the secondary channel (124). In this example, the external pump (FIG. 1, 111) and the secondary channel actuator (125) are controlled by the control device (130) so that the pressure exerted by the external pump (FIG. 1, 111) is relatively greater than the pressure exerted by the secondary channel actuator (125). This is graphically indicated by the size of the arrows depicted in FIG. 5A. Providing for a relatively greater pressure to be exerted by the external pump (FIG. 1, 111) than the secondary channel actuator (125) within the microfluidic mixing device (500) provides for a relatively lower grade of mixing among the fluids as compared to other examples described herein, but a high flow rate within the microfluidic mixing device (500). Thus, the example of FIG. 5A may be employed where total or good mixing of the fluids is not a goal, but fast flow rate within the main channel (121) and through the microfluidic mixing device (500) is an objective.

As to FIG. 5B, the flow throughout the main channel (121) and secondary channel (124) as indicated by the arrows creates an o-shaped (O) flow through the microfluidic mixing device (550). The secondary channel actuator (125) in the secondary channel (124) of FIG. 5B draws fluids from the main channel into a second leg (510) of the secondary channel (124), pushes the fluids through the curved portion of the u-shaped secondary channel (124), and reintroduces the fluids into the main channel (121) via the first leg (505) of the secondary channel (124). This flow forms an o-shape (O).

In addition to the o-shaped (O) flow through the microfluidic mixing device (550), the flow produced by the external pump (FIG. 1, 111) is relatively greater than the o-shaped (O) flow within the secondary channel (124). In this example, the external pump (FIG. 1, 111) and the secondary channel actuator (125) are controlled by the control device (130) so that the pressure exerted by the external pump (FIG. 1, 111) is relatively greater than the pressure exerted by the secondary channel actuator (125). This is graphically indicated by the size of the arrows depicted in FIG. 5B. Providing for a relatively greater pressure to be exerted by the external pump (FIG. 1, 111) than the secondary channel actuator (125) within the microfluidic mixing device (550) provides for relatively better mixing of the fluids than the microfluidic mixing device (500) of FIG. 5A, with a high flow rate within the microfluidic mixing device (550) as compared to other examples described herein. Thus, the example of FIG. 5B may be employed where total or good mixing of the fluids within the microfluidic mixing device (500) and a fast flow rate within the main channel (121) and through the microfluidic mixing device (500) are both goals.

FIG. 6A is a cross-sectional diagram of a parallel flow microfluidic mixing device (600) in which the secondary channel actuator (125) produces an approximately omega-shaped (Ω) flow through the microfluidic mixing device (600), according to one example of the principles described herein. FIG. 6B is a cross-sectional diagram of a counter-flow microfluidic mixing device (650) in which the secondary channel actuator (125) produces an o-shaped (O) flow through the microfluidic mixing device (650), according to one example of the principles described herein. As to FIG. 5A, the flow throughout the main channel (121) and secondary channel (124) as indicated by the arrows creates an approximately omega-shaped (Ω) flow through the secondary channel (124) of the microfluidic mixing device (600). The secondary channel actuator (125) in the secondary channel (124) of FIG. 6A draws fluids from the main channel (121) into a first leg (605) of the secondary channel (124), pushes the fluids through the curved portion of the u-shaped secondary channel (124), and reintroduces the fluids into the main channel (121) via the second leg (610) of the secondary channel (124). This flow through the secondary channel (124) forms an approximate omega-shape (Ω). Fluids flow within the main channel (121) as well. The fluids flowing in the main channel (121) mix with the fluids flowing through and exiting the secondary channel (124), and amalgamate the fluids.

In addition to the omega-shaped (Ω) flow through the microfluidic mixing device (600), the flow produced by the external pump (FIG. 1, 111) is relatively less than the omega-shaped (Ω) flow within the secondary channel (124). In this example, the external pump (FIG. 1, 111) and the secondary channel actuator (125) are controlled by the control device (130) so that the pressure exerted by the external pump (FIG. 1, 111) is relatively less than the pressure exerted by the secondary channel actuator (125). This is graphically indicated by the size of the arrows depicted in FIG. 6A. Providing for a relatively smaller pressure to be exerted by the external pump (FIG. 1, 111) than the secondary channel actuator (125) within the microfluidic mixing device (500) provides for a relatively effective grade of mixing among the fluids as compared to other examples described herein, but a low flow rate within the microfluidic mixing device (600). Thus, the example of FIG. 6A may be employed where total mixing of the fluids is a goal, but fast flow rate within the main channel (121) and through the microfluidic mixing device (500) is not an objective.

As to FIG. 6B, the flow throughout the main channel (121) and secondary channel (124) as indicated by the arrows creates an o-shaped (O) flow through the microfluidic mixing device (650). The secondary channel actuator (125) in the secondary channel (124) of FIG. 6B draws fluids from the main channel into a second leg (610) of the secondary channel (124), pushes the fluids through the curved portion of the u-shaped secondary channel (124), and reintroduces the fluids into the main channel (121) via the first leg (605) of the secondary channel (124). This flow forms an o-shape (O).

In addition to the o-shaped (O) flow through the microfluidic mixing device (650), the flow produced by the external pump (FIG. 1, 111) is relatively less than the o-shaped (O) flow within the secondary channel (124). In this example, the external pump (FIG. 1, 111) and the secondary channel actuator (125) are controlled by the control device (130) so that the pressure exerted by the external pump (FIG. 1, 111) is relatively less than the pressure exerted by the secondary channel actuator (125). This is graphically indicated by the size of the arrows depicted in FIG. 6B. Providing for a relatively smaller pressure to be exerted by the external pump (FIG. 1, 111) than the secondary channel actuator (125) within the microfluidic mixing device (650) provides for relatively better mixing of the fluids than the microfluidic mixing device (500) of FIG. 5A, with a relatively effective grade of mixing among the fluids as compared to other examples described herein, but a lower flow rate within the microfluidic mixing device (650). Thus, the example of FIG. 6B may be employed where total mixing of the fluids within the microfluidic mixing device (500) is a goal, but fast flow rate within the main channel (121) and through the microfluidic mixing device (500) is not an objective.

Additional variations of FIGS. 2A through 6B are found in FIGS. 7A through 13B. While numerous configurations are illustrated and discussed with regard to FIGS. 7A through 13B, these configurations do not provide an exhaustive account of all possible configurations. Therefore, other configurations are possible and are contemplated by this disclosure. In addition, while the actuators (FIG. 1, 123, 125) are illustrated in FIGS. 7A through 13B as being of a uniform size, various other actuators are contemplated having non-uniform sizes.

In FIGS. 7A through 13B, actuators (FIG. 1, 123, 125) within the microfluidic mixing device (120) provide active microfluidic mixing through the controlled activation of a number of the actuators (FIG. 1, 123, 125). As noted above, the control device (130) and its processor (131) provide such control through execution of various modules (e.g., the pump actuator module (136)) and data obtained from the host device (140). Instructions executable on processor (131) enable selective and controlled activation of the actuators (FIG. 1, 123, 125).

The microfluidic mixing device (120) achieves a mixing effect in the fluids passing through the main channel (121) by controlling a number of actuators (FIG. 1, 123, 125). In one example, the actuators (FIG. 1, 123, 125) may be activated in an alternating sequence of activation. In this example, as fluids pass over the actuators (FIG. 1, 123, 125), the alternating activation of the actuators (FIG. 1, 123, 125) generates fluid displacements that create a wiggling fluid flow path. The wiggling fluid flow path causes the fluids to mix with a mixing efficiency that exceeds that of mixing by diffusion.

Among the numerous possible actuator (FIG. 1, 123, 125) configurations shown in FIGS. 7A through 13B, there are an equal or greater number of alternating activation sequences or mixing protocols that may be applied. The alternating sequences of activation may or may not include a time delay between different successive activations. For example, referring to FIG. 2A, the main channel (121) comprises a single main channel actuator (123). In this example, an alternating sequence of activation can include an activation of the actuator (123), followed by a time delay, and followed by another activation of the actuator (123). This time delayed actuation may be performed any number of iterations. The activation of an actuator (123) may last for a predetermined time duration that may be adjusted and programmably controlled by the control device (130).

In another example, two or more actuators (123) may be located within the main channel (121). In this example, an alternating sequence of activation may comprise an activation of a first actuator (123) which lasts for a first time duration, followed by an activation of the second actuator (123) which lasts for a second time duration, followed thereafter by another activation of the first actuator (123). This actuation series may be performed any number of iterations. In one example, the activation of the two actuators (123) alternates such that the two actuators (123) are not activated simultaneously. During the activation time of the first actuator (123), the second actuator (123) is idle. The second actuator (123) is then activated directly after the completion of the activation time of the first actuator (123), with no time delay between when the first actuator (123) activation ends, and when the second actuator (123) activation begins. Therefore, in such an alternating sequence of activation, there is no time delay between successive activations of the two (123).

In another example, a different alternating sequence of activation can also include an activation of a first actuator (123) for a predetermined time duration, followed by a time delay, followed by an activation of the second actuator (123) for a preset time duration, followed by a time delay, followed by another activation of the first actuator (123). This time delayed actuation may be performed any number of iterations. The two actuators (123) are activated in turn; one after the other in a non-simultaneous manner, and a time delay is inserted in between the end of one activation and the beginning of a next activation. Therefore, in such a different alternating sequence of activation, there are time delays between successive activations of the actuators (123).

The above examples are examples of the activation of a number of main channel actuators (123). The same examples described in connection with the actuation of the main channel actuators (123) may also be applied to a number of secondary channel actuators (125). Further, in another example, the actuation of the main channel actuators (123) with respect to the actuation of the secondary channel actuators (125) and the timing and time delays between actuation associated therewith may follow the examples described above in connection with the activation of the main channel actuators (123).

Throughout the examples described herein, the secondary channels (124) and their associated secondary channel actuators (125) produce flow of fluids that assist in the mixing of the fluids within the main channel (121). In one example, the flow rate of fluids within the main channel (121) may be slower relative to the flow rate of the fluids within the secondary channels (124). This may be achieved by tuning a number of parameters. These tunable parameters comprise, for example: maintaining a slower activation rate (Hz) of the main channel actuators (123) with respect to the secondary channel actuators (125); increasing the area and width of the secondary channels (124); adjusting firing rates of the actuators (123, 125) and pump (FIG. 1, 111) and actuator (123, 125) sizes; increasing the number of secondary channel actuators (123); or combinations thereof.

In light of the above, and turning now to FIGS. 7A through 13B, the examples described throughout these figures comprise a plurality of secondary channels (124) fluidly coupled to the main channels (121). The plurality of secondary channels (124) provide for additional mixing of the fluids within the microfluidic mixing device (FIG. 1, 120). The examples of microfluidic mixing devices (700, 730, 750) of FIGS. 7A through 7C comprise two secondary channels (124-1, 124-2). The two secondary channels (124-1, 124-2) of each of the microfluidic mixing devices (700, 730, 750) interact with the flows created by each other and the flow of fluids created the main channel (121).

Figure 7A:
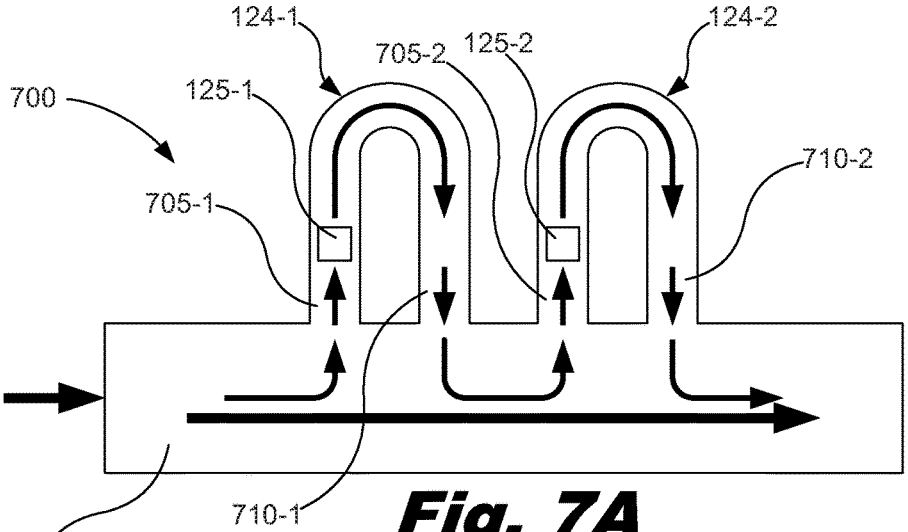
FIG. 7A is a cross-sectional diagram of a double looped microfluidic mixing device in which the secondary channel actuators produce a number of approximately omega-shaped (Ω) flows through the microfluidic mixing device, according to one example of the principles described herein.

For example, FIG. 7A is a cross-sectional diagram of a double looped microfluidic mixing device (700) in which the secondary channel actuators (125-1, 125-2) produce a number of approximately omega-shaped (Ω) flows through the microfluidic mixing device (700), according to one example of the principles described herein. In the example of FIG. 7A, the fluids flow into the two secondary channels (124-1, 124-2) from the main channel (121) via the first legs (705-1, 705-2) of the u-shaped appendage of the two secondary channels (124-1, 124-2). The fluids then flow through the two secondary channels (124-1, 124-2), and are reintroduced into the main channel (121) via the second legs (710-1, 710-2) of the u-shaped appendage. Flow of fluids between the two secondary channels (124-1, 124-2) exists where the fluids exiting the second leg (710-1) of the first secondary channel (124-1) are drawn into the first leg (705-2) of the second secondary channel (124-2). This interaction between a number of secondary channels (124-1, 124-2) of the microfluidic mixing device (700) provide for the fluids exiting the second leg (710-1) of the first secondary channel (124-1) to interact and mix with fluids within the main channel (121) before being drawn into a subsequent secondary channel (124-2). This, therefore, increases the number of times that the fluids drawn into the secondary channels (124-1, 124-2) are able to interact with the fluids passing within the main channel (121). In this manner, additional instances of the fluids experiencing a number of transverse flows within the main channel (121) of the microfluidic mixing device (FIG. 1, 120) and displacement with respect to other fluids are present within the microfluidic mixing device (700). Although only two secondary channels (124-1, 124-2) are depicted in FIG. 7A, any number of secondary channels (124-1, 124-2) may be fluidly coupled to the main channel (121) to increase these instances of transverse flows and displacements.

Figure 7B:
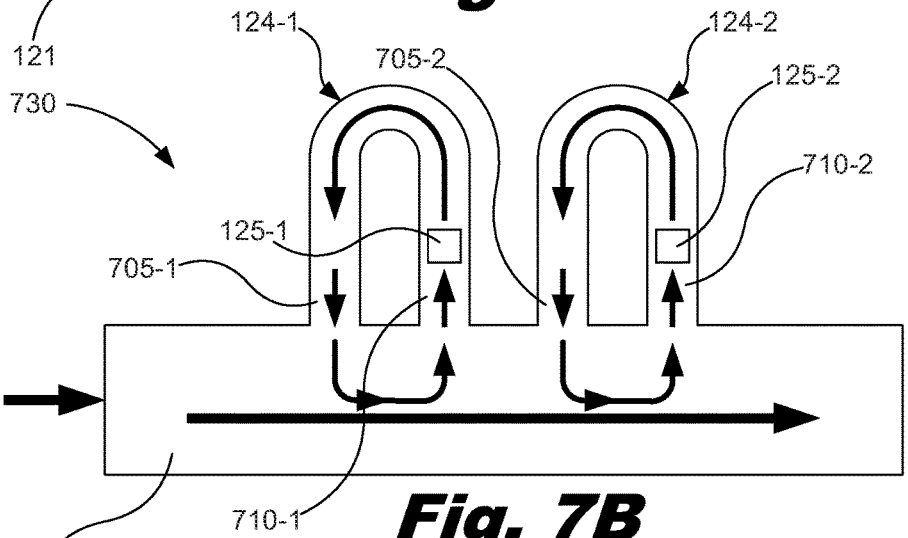
FIG. 7B is a cross-sectional diagram of a double looped microfluidic mixing device in which the secondary channel actuators produce a number of o-shaped (O) flows through the microfluidic mixing device, according to one example of the principles described herein.

FIG. 7B is a cross-sectional diagram of a double looped microfluidic mixing device (730) in which the secondary channel actuators (125-1, 125-2) produce a number of o-shaped (O) flows through the microfluidic mixing device (730), according to one example of the principles described herein. In the example of FIG. 7B, the fluids flow into the two secondary channels (124-1, 124-2) from the main channel (121) via the second legs (710-1, 710-2) of the u-shaped appendage of the two secondary channels (124-1, 124-2). The fluids then flow through the two secondary channels (124-1, 124-2), and are reintroduced into the main channel (121) via the first legs (705-1, 705-2) of the u-shaped appendage. In this example, two o-shaped (O) flows are produced. The interaction between a number of secondary channels (124-1, 124-2) of the microfluidic mixing device (730) with the fluids in the main channel (121) provide for an increase in the number of times that the fluids drawn into the secondary channels (124-1, 124-2) are able to interact with the fluids passing within the main channel (121). In this manner, additional instances of the fluids experiencing a number of transverse flows within the main channel (121) of the microfluidic mixing device (FIG. 1, 120) and displacement with respect to other fluids is experienced. Again, although only two secondary channels (124-1, 124-2) are depicted in FIG. 7B, any number of secondary channels (124-1, 124-2) may be fluidly coupled to the main channel (121) to increase these instances of transverse flows and displacements.

Figure 7C:
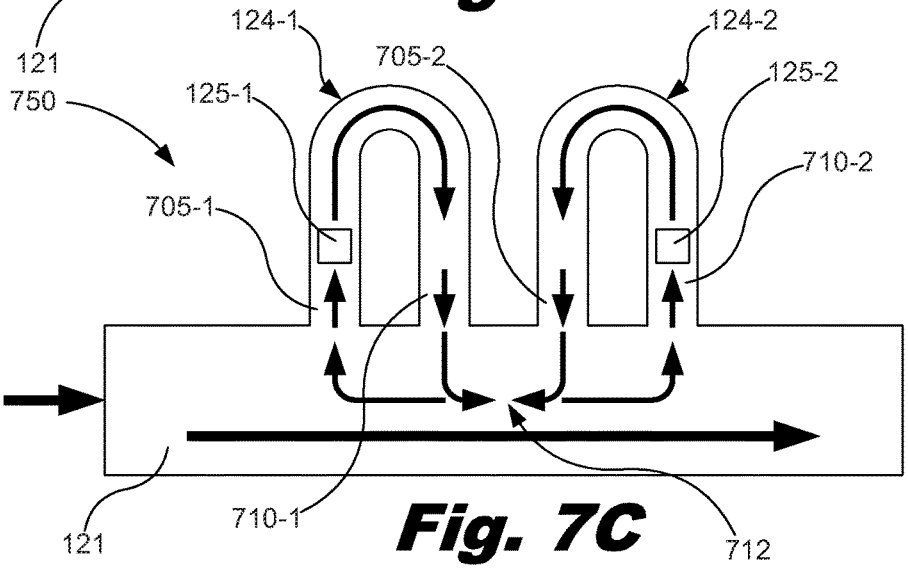
FIG. 7C is a cross-sectional diagram of a double looped microfluidic mixing device in which the secondary channel actuators produce a counter-flow through the microfluidic mixing device, according to one example of the principles described herein.

FIG. 7C is a cross-sectional diagram of a double looped microfluidic mixing device (750) in which the secondary channel actuators (125-1, 125-2) produce a counter-flow through the microfluidic mixing device (750), according to one example of the principles described herein. In the example of FIG. 7C, the fluids flow into the two secondary channels (124-1, 124-2) from the main channel (121) via the first leg (705-1) of the u-shaped appendage of the first secondary channel (124-1), and via the second leg (710-2) of the u-shaped appendage of the second secondary channel (124-2). The fluids then flow through the two secondary channels (124-1, 124-2), and are reintroduced into the main channel (121) via the second leg (710-1) of the u-shaped appendage of the first secondary channel (124-1), and via the first leg (705-2) of the u-shaped appendage of the second secondary channel (124-2). In this manner, the flow of fluids within the two secondary channels (124-1, 124-2) are in opposite directions; one in a clockwise direction, and the other in a counter-clockwise direction. In another example, the direction of flow within the two secondary channels (124-1, 124-2) is opposite with respect to each other, but opposite from the above example where the fluids flowing through the first secondary channel (124-1) is in a counter-clockwise direction, and the flow of fluids in the second secondary channel (124-2) is in a clockwise direction.

In the example of FIG. 7C, two counter-flowing flows are produced. The interaction between a number of secondary channels (124-1, 124-2) of the microfluidic mixing device (750) creates a number of transverse flows between the two counter flows at point 712. This creates a major point of transverse flows between the flows produced by the secondary channels (124-1, 124-2) and the main channel (121). This, in turn, provides for an increase in the number of times that the fluids drawn into the secondary channels (124-1, 124-2) are able to interact with the fluids passing within the main channel (121). In this manner, additional instances of the fluids experiencing a number of transverse flows within the main channel (121) of the microfluidic mixing device (FIG. 1, 120) and displacement with respect to other fluids is experienced. Again, although only two secondary channels (124-1, 124-2) are depicted in FIG. 7C, any number of counter-flowing secondary channels (124-1, 124-2) may be fluidly coupled to the main channel (121) to increase these instances of transverse flows and displacement.

Figure 8A:
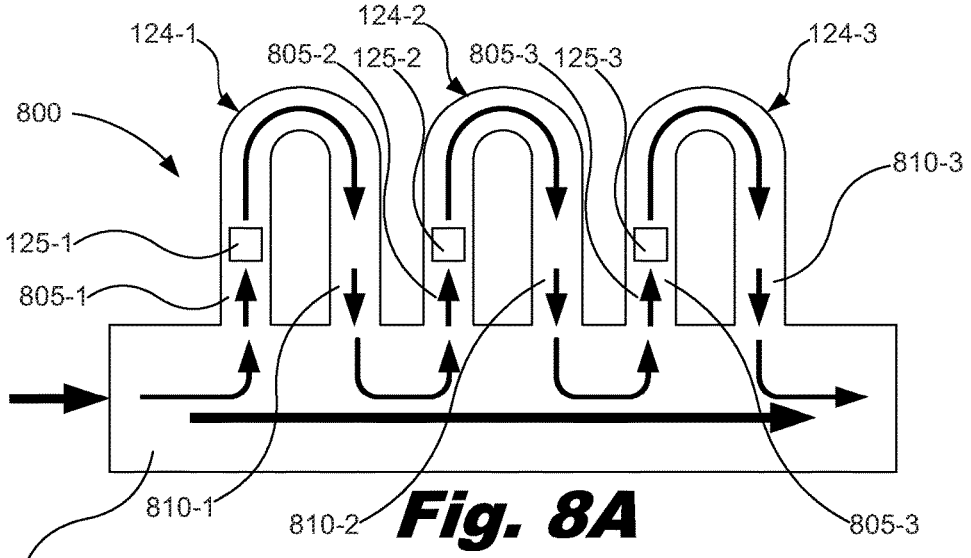
FIG. 8A is a cross-sectional diagram of a triple looped microfluidic mixing device in which the secondary channel actuators produce a number of approximately omega-shaped (Ω) flows through the microfluidic mixing device, according to one example of the principles described herein.

FIG. 8A is a cross-sectional diagram of a triple looped microfluidic mixing device (800) in which the secondary channel actuators produce a number of approximately omega-shaped (Ω) flows through the microfluidic mixing device, according to one example of the principles described herein. In the example of FIG. 8A, the fluids flow into the three secondary channels (124-1, 124-2, 124-3) from the main channel (121) via the first legs (805-1, 805-2, 805-3) of the u-shaped appendage of the three secondary channels (124-1, 124-2, 124-3). The fluids then flow through the three secondary channels (124-1, 124-2, 124-3), and are reintroduced into the main channel (121) via the second legs (810-1, 810-2, 810-3) of the u-shaped appendage.

Flow of fluids between the three secondary channels (124-1, 124-2, 124-3) exist where the fluids exiting the second leg (810-1) of the first secondary channel (124-1) are drawn into the first leg (805-2) of the second secondary channel (124-2) and where the fluids exiting the second leg (810-2) of the second secondary channel (124-2) are drawn into the first leg (805-3) of the third secondary channel (124-3). This interaction between a number of secondary channels (124-1, 124-2) of the microfluidic mixing device (800) provide for the fluids exiting the second leg (810-1, 810-2) of the first and second secondary channels (124-1, 124-2) to interact and mix with fluids within the main channel (121) before being drawn into a subsequent secondary channel (124-2, 124-3), respectively. This, therefore, increases the number of times that the fluids drawn into the secondary channels (124-1, 124-2, 124-3) are able to interact with the fluids passing within the main channel (121). In this manner, additional instances of the fluids experiencing a number of transverse flows within the main channel (121) of the microfluidic mixing device (FIG. 1, 120) and displacement with respect to other fluids is experienced. Although only three secondary channels (124-1, 124-2, 124-3) are depicted in FIG. 8A, any number of secondary channels (124-1, 124-2, 124-3) may be fluidly coupled to the main channel (121) to increase these instances of transverse flows and displacements.

Figure 8B:
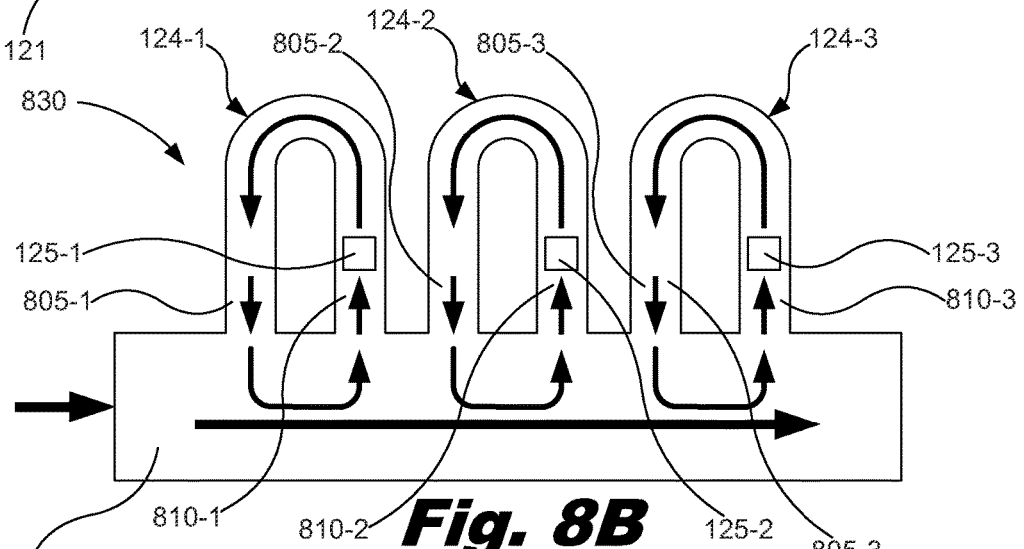
FIG. 8B is a cross-sectional diagram of a triple looped microfluidic mixing device in which the secondary channel actuators produce a number of o-shaped (O) flows through the microfluidic mixing device, according to one example of the principles described herein.

FIG. 8B is a cross-sectional diagram of a triple looped microfluidic mixing device (830) in which the secondary channel actuators produce a number of o-shaped (O) flows through the microfluidic mixing device (830), according to one example of the principles described herein. In the example of FIG. 8B, the fluids flow into the three secondary channels (124-1, 124-2, 124-3) from the main channel (121) via the second legs (810-1, 810-2, 810-3) of the u-shaped appendage of the three secondary channels (124-1, 124-2, 124-3). The fluids then flow through the three secondary channels (124-1, 124-2, 124-3), and are reintroduced into the main channel (121) via the first legs (805-1, 805-2, 805-3) of the u-shaped appendage. In this example, three o-shaped (O) flows are produced. The interaction between a number of secondary channels (124-1, 124-2, 124-3) of the microfluidic mixing device (830) with the fluids in the main channel (121) provide for an increase in the number of times that the fluids drawn into the secondary channels (124-1, 124-2, 124-3) are able to interact with the fluids passing within the main channel (121). In this manner, additional instances of the fluids experiencing a number of transverse flows within the main channel (121) of the microfluidic mixing device (FIG. 1, 120) and displacement with respect to other fluids is experienced. Again, although only three secondary channels (124-1, 124-2, 124-3) are depicted in FIG. 8B, any number of secondary channels (124-1, 124-2, 124-3) may be fluidly coupled to the main channel (121) to increase these instances of transverse flows and displacements.

Figure 8C:
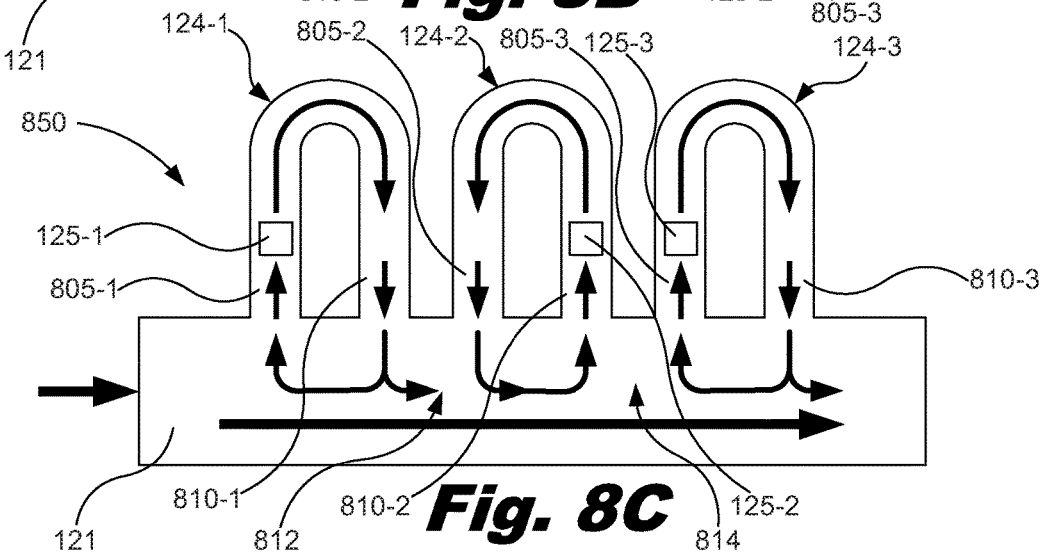
FIG. 8C is a cross-sectional diagram of a triple looped microfluidic mixing device in which the secondary channel actuators produce a number of counter-flows through the microfluidic mixing device, according to one example of the principles described herein.

FIG. 8C is a cross-sectional diagram of a triple looped microfluidic mixing device (850) in which the secondary channel actuators produce a number of counter-flows through the microfluidic mixing device, according to one example of the principles described herein. In the example of FIG. 8C, the fluids flow into the three secondary channels (124-1, 124-2, 124-3) from the main channel (121) via the first leg (805-1) of the u-shaped appendage of the first secondary channel (124-1), via the second leg (810-2) of the u-shaped appendage of the second secondary channel (124-2), and via the first leg (805-3) of the u-shaped appendage of the third secondary channel (124-3). The fluids then flow through the three secondary channels (124-1, 124-2, 124-3), and are reintroduced into the main channel (121) via the second leg (810-1) of the u-shaped appendage of the first secondary channel (124-1), via the first leg (805-2) of the u-shaped appendage of the second secondary channel (124-2), and via the second leg (810-3) of the u-shaped appendage of the third secondary channel (124-3). In this manner, the flow of fluids within the three secondary channels (124-1, 124-2, 124-3) is in opposite directions with respect to two adjacent secondary channels (124-1, 124-2, 124-3). Thus, a secondary channel (124-1, 124-2, 124-3) flows in a clockwise direction, and a subsequent secondary channel (124-1, 124-2, 124-3) flows in a counter-clockwise direction, or visa versa. In another example, the direction of flow within the three secondary channels (124-1, 124-2) is opposite with respect to each other, but opposite from the above example where the flow of fluids through the first secondary channel (124-1) is in a counter-clockwise direction, the flow of fluids in the second secondary channel (124-2) is in a clockwise direction, and the flow of fluids through the third secondary channel (124-3) is in a counter-clockwise direction.

In the example of FIG. 8C, four counter-flowing flows are produced. The interaction between a number of secondary channels (124-1, 124-2, 124-3) of the microfluidic mixing device (850) creates a number of transverse flows between the three counter flows at points 812 and 814. This creates a major point of amalgamation between the flows produced by the secondary channels (124-1, 124-2, 124-3) and the main channel (121). This, in turn, provides for an increase in the number of times that the fluids drawn into the secondary channels (124-1, 124-2, 124-3) are able to interact with the fluids passing within the main channel (121). In this manner, additional instances of the fluids experiencing a number of transverse flows within the main channel (121) of the microfluidic mixing device (FIG. 1, 120) and displacement with respect to other fluids is experienced. Again, although only three secondary channels (124-1, 124-2, 124-3) are depicted in FIG. 8C, any number of counter-flowing secondary channels (124-1, 124-2, 124-3) may be fluidly coupled to the main channel (121) to increase these instances of transverse flows and displacement.

Figure 9:
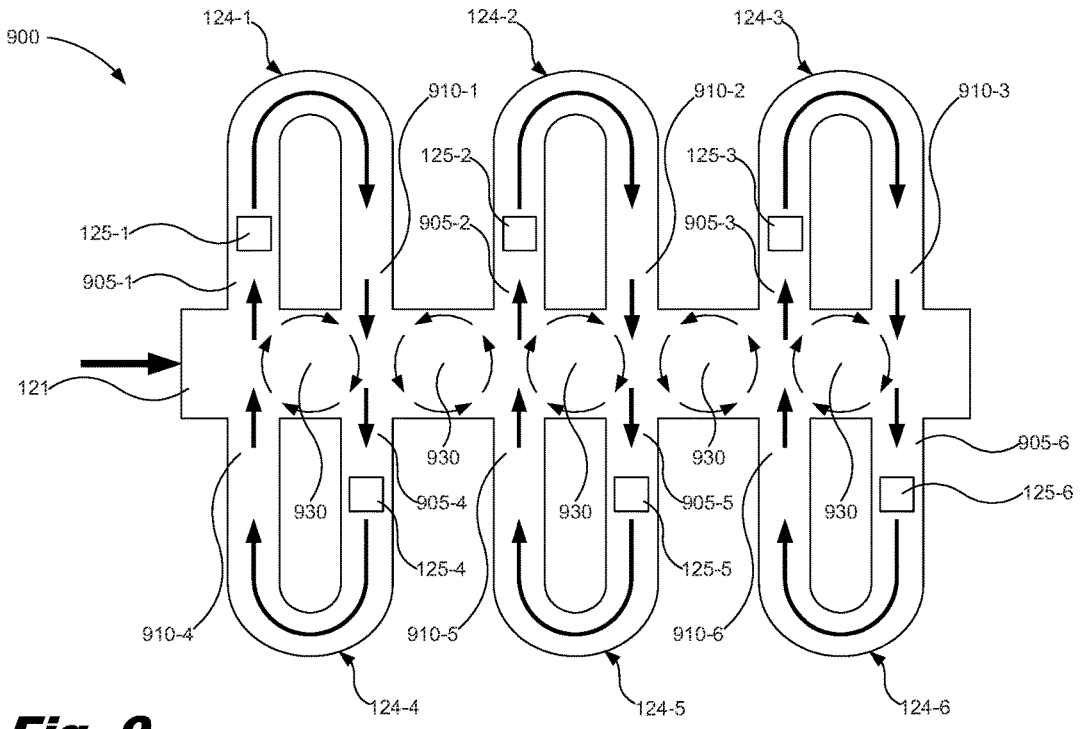
FIG. 9 is a cross-sectional diagram of a sextuple looped microfluidic mixing device in which the secondary channel actuators produce a number of cross-channel o-shaped (O) flows through the microfluidic mixing device, according to one example of the principles described herein.

FIG. 9 is a cross-sectional diagram of a sextuple looped microfluidic mixing device (900) in which the secondary channel actuators (125-1, 125-2, 125-3, 125-4, 125-5, 125-6) produce a number of cross-channel o-shaped (O) flows through the microfluidic mixing device (900), according to one example of the principles described herein. In the example of FIG. 9, the fluids flow into the six secondary channels (124-1, 124-2, 124-3, 124-4, 124-5, 124-6) from the main channel (121) via the first legs (905-1, 905-2, 905-3, 905-4, 905-5, 905-6) of the u-shaped appendage of the six secondary channels (124-1, 124-2, 124-3, 124-4, 124-5, 124-6). The fluids then flow through the six secondary channels (124-1, 124-2, 124-3, 124-4, 124-5, 124-6), and are reintroduced into the main channel (121) via the second legs (910-1, 910-2, 910-3, 910-4, 910-5, 910-6) of the u-shaped appendage.

Flow of fluids between the two sets of three secondary channels (124-1, 124-2, 124-3, and 124-4, 124-5, 124-6) exist where the fluids exiting the second leg (910-1, 910-2, 910-3, 910-4, 910-5, 910-6) of a secondary channel (124-1, 124-2, 124-3, 124-4, 124-5, 124-6) are drawn into the first leg (905-1, 905-2, 905-3, 905-4, 905-5, 905-6) of a secondary channel (124-1, 124-2, 124-3, 124-4, 124-5, 124-6) opposite (in the vertical direction) of that secondary channel (124-1, 124-2, 124-3, 124-4, 124-5, 124-6). In this manner, the output of the first secondary channel (124-1) is the input to the sixth secondary channel (124-6), and visa versa. Similarly, the output of the second secondary channel (124-2) is the input to the fifth secondary channel (124-5), and the output of the third secondary channel (124-3) is the input to the fourth secondary channel (124-4), and visa versa. This cross flow created between opposite secondary channels (124-1, 124-2, 124-3, 124-4, 124-5, 124-6) creates a number of vortexes (930) within the main channel (121) of the microfluidic mixing device (900) as indicated by the circularly arranged arrows depicted in the main channel (121). The interaction between vertically opposite secondary channels (124-1, 124-2, 124-3, 124-4, 124-5, 124-6) therefore, creates the vertexes (930). The vertexes (930) are created between vertically opposite secondary channels (124-1, 124-2, 124-3, 124-4, 124-5, 124-6) as well as between groups of vertically opposite secondary channels (124-1, 124-2, 124-3, 124-4, 124-5, 124-6). It is noted that the vertexes flow in opposite directions with respect to a neighboring vertex. When fluids flow into the main channel (121) and are subjected to the transverse flows created by the secondary channels (124-1, 124-2, 124-3, 124-4, 124-5, 124-6) and the vertexes (930), the fluids experience an extremely high level of mixing.

Figure 10:
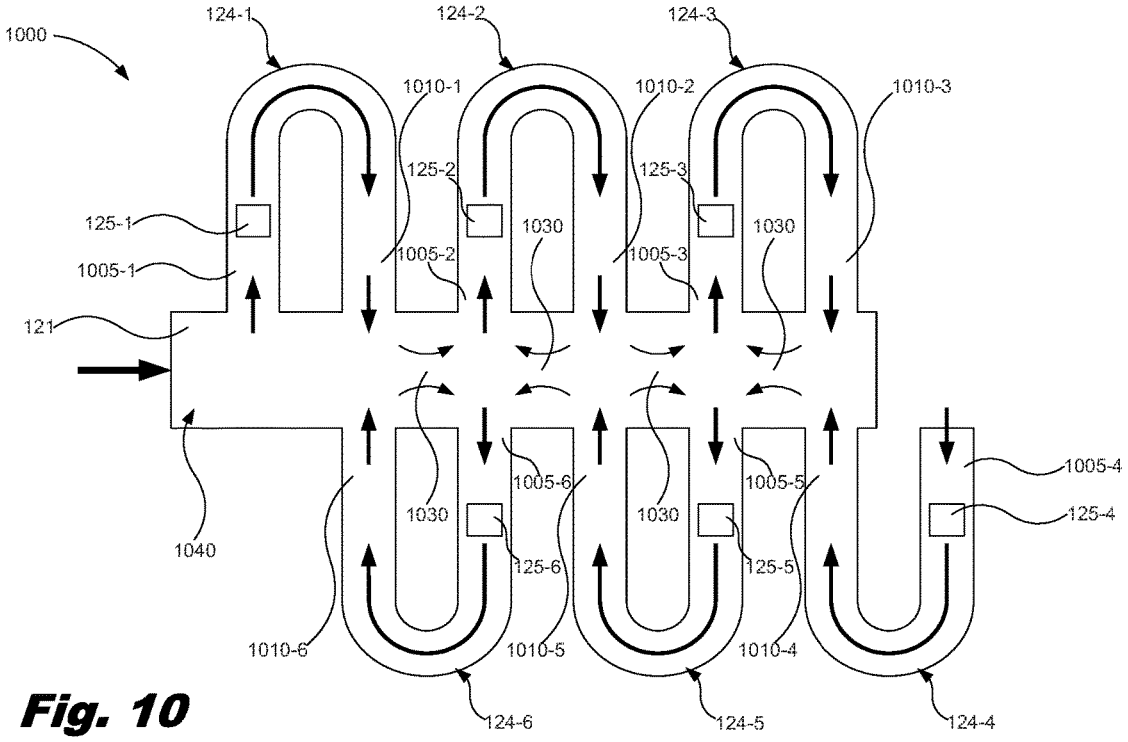
FIG. 10 is a cross-sectional diagram of a sextuple looped microfluidic mixing device in which the secondary channel actuators produce a number of cross-channel, approximately omega-shaped (Ω) flows through the microfluidic mixing device, according to one example of the principles described herein.

FIG. 10 is a cross-sectional diagram of a sextuple looped microfluidic mixing device (1000) in which the secondary channel actuators (125-1, 125-2, 125-3, 125-4, 125-5, 125-6) produce a number of cross-channel, approximately omega-shaped (Ω) flows (1030) through the microfluidic mixing device (1000), according to one example of the principles described herein. In the example of FIG. 10, the fluids flow into the six secondary channels (124-1, 124-2, 124-3, 124-4, 124-5, 124-6) from the main channel (121) via the first legs (1005-1, 1005-2, 1005-3, 1005-4, 1005-5, 1005-6) of the u-shaped appendage of the six secondary channels (124-1, 124-2, 124-3, 124-4, 124-5, 124-6). The fluids then flow through the six secondary channels (124-1, 124-2, 124-3, 124-4, 124-5, 124-6), and are reintroduced into the main channel (121) via the second legs (1010-1, 1010-2, 1010-3, 1010-4, 1010-5, 1010-6) of the u-shaped appendage.

Flow of fluids between the two sets of three secondary channels (124-1, 124-2, 124-3, and 124-4, 124-5, 124-6) exist where the flow of fluids exiting the second leg (1010-1, 1010-2, 1010-3, 1010-4, 1010-5, 1010-6) of a first secondary channel (124-1, 124-2, 124-3, 124-4, 124-5, 124-6) is directly opposite to the flow of fluids exiting the second leg (1010-1, 1010-2, 1010-3, 1010-4, 1010-5, 1010-6) of a secondary channel (124-1, 124-2, 124-3, 124-4, 124-5, 124-6) opposite the first secondary channel (124-1, 124-2, 124-3, 124-4, 124-5, 124-6). Similarly, flow of fluids between the two sets of three secondary channels (124-1, 124-2, 124-3, and 124-4, 124-5, 124-6) exist where the flow of fluids entering the first leg (1005-1, 1005-2, 1005-3, 1005-4, 1005-5, 1005-6) of a first secondary channel (124-1, 124-2, 124-3, 124-4, 124-5, 124-6) are directly opposite to the flow of fluids entering the first leg (1005-1, 1005-2, 1005-3, 1005-4, 1005-5, 1005-6) of a secondary channel (124-1, 124-2, 124-3, 124-4, 124-5, 124-6) opposite the first secondary channel (124-1, 124-2, 124-3, 124-4, 124-5, 124-6). As depicted in FIG. 10, the secondary channels (124-1, 124-2, 124-3, 124-4, 124-5, 124-6) are vertically offset from a pair of secondary channels (124-1, 124-2, 124-3, 124-4, 124-5, 124-6). In other words, the sixth secondary channel (124-6) is offset from the first and second secondary channels (124-1, 124-2) positioned across the main channel (121) from the sixth secondary channel (124-6).

Due to the offset nature of the secondary channels (124-1, 124-2, 124-3, 124-4, 124-5, 124-6), one secondary channel (124-1, 124-2, 124-3, 124-4, 124-5, 124-6) may comprise a leg that is not fluidly coupled to the main channel (121). In the example of FIG. 10, the fourth secondary channel (124-4) comprises a first leg (1005-4) that is not fluidly coupled to the main channel (121). Thus, the fourth secondary channel actuator (125-4) may be located in a terminating secondary channel. In this example, the fourth secondary channel actuator (125-4) allows for fluids that enter the fourth secondary channel actuator (125-4) to flood and drain into and out of the fourth secondary channel actuator (125-4), respectively. In another example, the first leg (1005-4) of the fourth secondary channel (124-4) may be fluidly coupled to a portion of the main channel (121). In this example, the length of the fourth secondary channel (124-4) may be extended to fluidly coupled to, for example, the area of the main channel (121) designated by 1040.

The offset groups of secondary channels (124-1, 124-2, 124-3, 124-4, 124-5, 124-6) create a number of parallel pairs of flows (1030). Each alternating parallel pairs of flows (1030) flow in a direction opposite a neighboring parallel pair of flows (1030). When fluids flow into the main channel (121) and are subjected to the transverse flows created by the secondary channels (124-1, 124-2, 124-3, 124-4, 124-5, 124-6) and the parallel pairs of flows (1030), the fluids experience an extremely high level of mixing.

Figure 11:
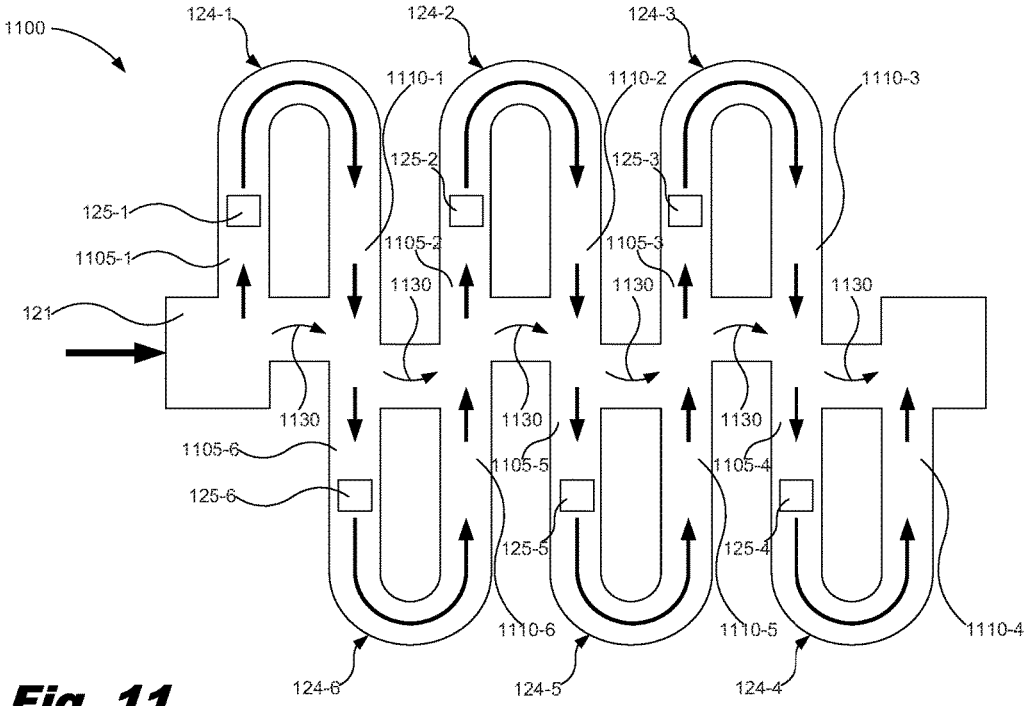
FIG. 11 is a cross-sectional diagram of a sextuple looped microfluidic mixing device in which the secondary channel actuators produce a serpentine flow through the microfluidic mixing device, according to one example of the principles described herein.

FIG. 11 is a cross-sectional diagram of a sextuple looped microfluidic mixing device (1100) in which the secondary channel actuators (124-1, 124-2, 124-3, 124-4, 124-5, 124-6) produce a serpentine flow through the microfluidic mixing device (1100), according to one example of the principles described herein. In the example of FIG. 11, the fluids flow into the six secondary channels (124-1, 124-2, 124-3, 124-4, 124-5, 124-6) from the main channel (121) via the first legs (1105-1, 1105-2, 1105-3, 1105-4, 1105-5, 1105-6) of the u-shaped appendage of the six secondary channels (124-1, 124-2, 124-3, 124-4, 124-5, 124-6). The fluids then flow through the six secondary channels (124-1, 124-2, 124-3, 124-4, 124-5, 124-6), and are reintroduced into the main channel (121) via the second legs (1110-1, 1110-2, 1110-3, 1110-4, 1110-5, 1110-6) of the u-shaped appendage.

Flow of fluids between the two sets of three secondary channels (124-1, 124-2, 124-3, and 124-4, 124-5, 124-6) exist where the flow of fluids exiting the second leg (1110-1, 1110-2, 1110-3, 1110-4, 1110-5, 1110-6) of a first secondary channel (124-1, 124-2, 124-3, 124-4, 124-5, 124-6) is the same as the flow of fluids entering the first leg (1105-1, 1105-2, 1105-3, 1105-4, 1105-5, 1105-6) of a secondary channel (124-1, 124-2, 124-3, 124-4, 124-5, 124-6) opposite the first secondary channel (124-1, 124-2, 124-3, 124-4, 124-5, 124-6). As depicted in FIG. 11, the secondary channels (124-1, 124-2, 124-3, 124-4, 124-5, 124-6) are vertically offset from a pair of secondary channels (124-1, 124-2, 124-3, 124-4, 124-5, 124-6) such that the second legs (1110-1, 1110-2, 1110-3, 1110-4, 1110-5, 1110-6) are vertically aligned with first legs (1105-1, 1105-2, 1105-3, 1105-4, 1105-5, 1105-6) of secondary channels (124-1, 124-2, 124-3, 124-4, 124-5, 124-6) opposite from each other. In other words, the sixth secondary channel (124-6) is offset from the first and second secondary channels (124-1, 124-2) positioned across the main channel (121) from the sixth secondary channel (124-6). In this manner, the flow of fluids through the secondary channels (124-1, 124-2, 124-3, 124-4, 124-5, 124-6) creates a serpentine-shaped flow.

Further, due to the offset nature of the secondary channels (124-1, 124-2, 124-3, 124-4, 124-5, 124-6), the offset groups of secondary channels (124-1, 124-2, 124-3, 124-4, 124-5, 124-6) create a number of smaller serpentine flows (1130) within the main channel (121). Each of the smaller serpentine flows (1130) flow in the direction of the fluids as they were first introduced into the main channel (121). When fluids flow into the main channel (121) and are subjected to the transverse flows created by the secondary channels (124-1, 124-2, 124-3, 124-4, 124-5, 124-6), the secondary channels' (124-1, 124-2, 124-3, 124-4, 124-5, 124-6) associated serpentine flow, and the smaller serpentine flows (1130) within the main channel (121), the fluids experience an extremely high level of mixing.

Figure 12:
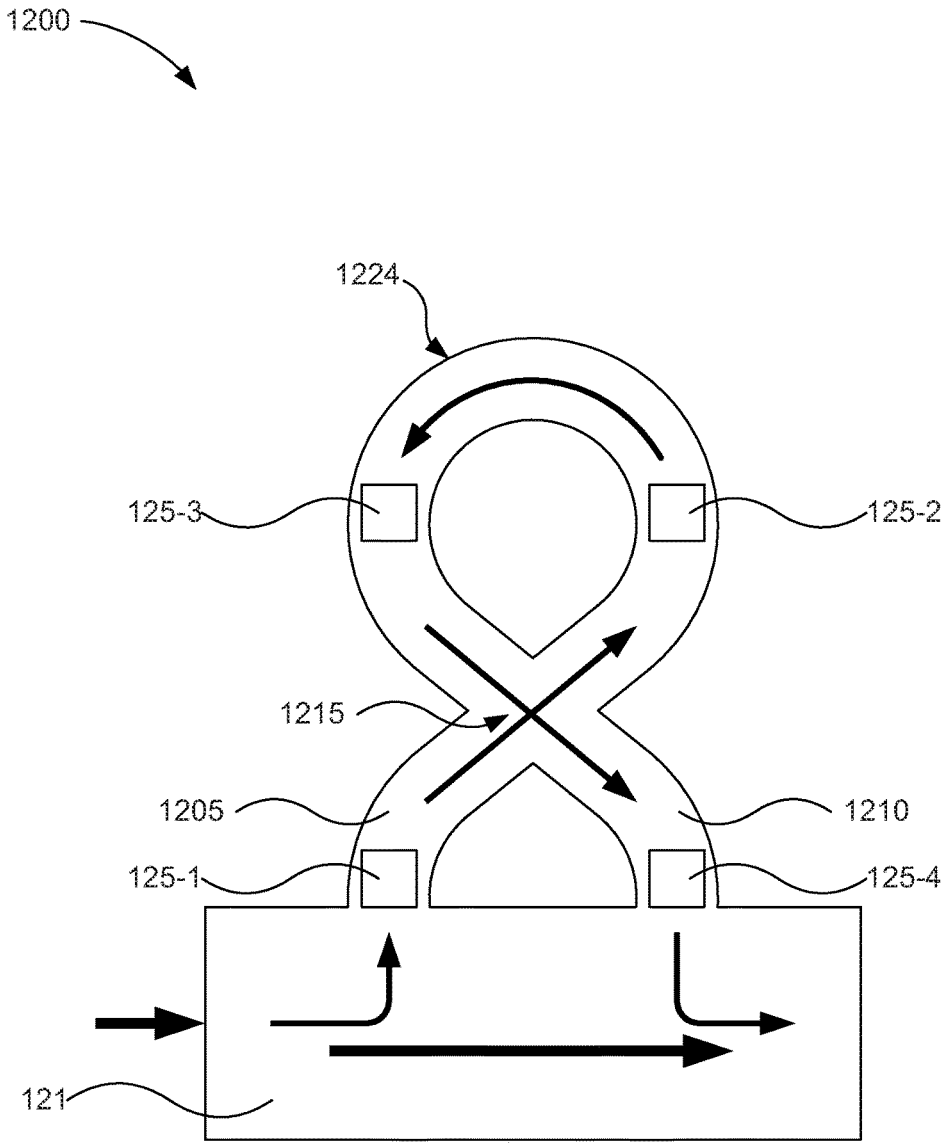
FIG. 12 is a cross-sectional diagram of a cut lemniscate-shaped microfluidic mixing device in which the secondary channel actuators produce a figure-eight-shaped flow through the microfluidic mixing device, according to one example of the principles described herein.

FIG. 12 is a cross-sectional diagram of a cut lemniscate-shaped microfluidic mixing device (1200) in which the secondary channel actuators (125-1, 125-2, 125-3, 125-4) produce a figure-eight-shaped flow through the microfluidic mixing device (1200), according to one example of the principles described herein. In the example of FIG. 12, although four secondary channel actuators (125-1, 125-2, 125-3, 125-4) are depicted any number of secondary channel actuators (125-1, 125-2, 125-3, 125-4) including fewer or more secondary channel actuators (125-1, 125-2, 125-3, 125-4) may be located within the cut lemniscate-shaped channel (1224). In the example of FIG. 12, the fluids flow into the cut lemniscate-shaped channel (1224) from the main channel (121) via the first leg (1205) of the cut lemniscate-shaped channel (1224). The fluids then flow through the figure-eight-shape, crossing an intersecting flow portion (1215) twice before being reintroduced into the main channel (121) via the second leg (1210) of the cut lemniscate-shaped channel (1224).

Fluids within the cut lemniscate-shaped channel (1224) experience a number of transverse flows at the intersecting flow portion (1215) as well as when entering and exiting the cut lemniscate-shaped channel (1224) from and to the main channel (121), respectively. In this manner, the flow of fluids through the cut lemniscate-shaped channel (1224) creates a figure-eight-shaped flow of fluids. Thus, due to the flow of fluids through the cut lemniscate-shaped channel (1224) and the transverse flows experienced at the intersecting flow portion (1215), the fluids experience a high level of mixing. In one example, the cross-sectional area within the cut lemniscate-shaped channel (1224) may vary in size along its length. Further, the secondary channel actuators (125-1, 125-2, 125-3, 125-4) may be actuated to move fluids in either direction within the cut lemniscate-shaped channel (1224). In one example, for improved directionality control of the flows in the figure-eight channels (1224) additional channel cross-section variations such as pinches, islands, and narrowing channels can be formed in the microfluidic mixing device (FIG. 1, 120). In another example, flow directionality may be additionally controlled by timing of activation of the actuators (125).

Figure 13A:
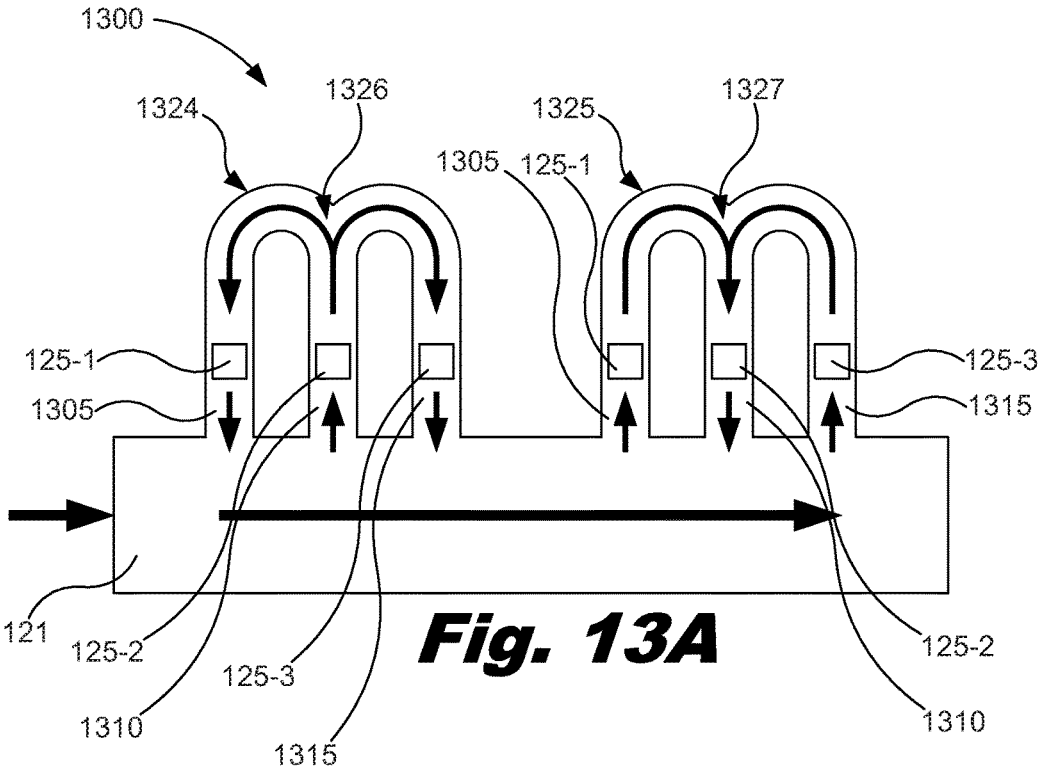
FIG. 13A is a cross-sectional diagram of an M-shaped microfluidic mixing device in which the secondary channel actuators produce an M-shaped (M) flow through the microfluidic mixing device, according to one example of the principles described herein.

FIG. 13A is a cross-sectional diagram of a M-shaped microfluidic mixing device (1300) in which the secondary channel actuators produce an M-shaped (M) flow through the microfluidic mixing device (1300), according to one example of the principles described herein. In the example of FIG. 13A, although three secondary channel actuators (125-1, 125-2, 125-3) are depicted any number of secondary channel actuators (125-1, 125-2, 125-3, 125-4) including fewer or more secondary channel actuators (125-1, 125-2, 125-3) may be located within the M-shaped channels (1324, 1325). In the example of FIG. 13A, the fluids flow into the M-shaped channel (1324) from the main channel (121) via the second leg (1310), through a splitting portion (1326), into the first (1305) and third (1315) legs of the M-shaped channel (1324), and back into the main channel (121). Thus, the splitting portion (1326) diverges the flow into two within the M-shaped channel (1324) via the second leg (1310) and creates two instances of transverse flow when the fluids flow back into the main channel (121).

In the example of FIG. 13A, the fluids flow into the M-shaped channel (1325) from the main channel (121) via the first (1305) and third (1315) legs, combine in the second leg (1310) at combination portion (1327), and flow back into the main channel (121) via the second leg (1310). Thus, the combination portion (1327) combines the flows within the first (1305) and third (1315) legs via the second leg (1310) to create a single flow from two flows, and a single instance of a transverse flow when the fluids flow back into the main channel (121).

The two M-shaped channels (1324, 1325) sample from (in the case of 1325) or create a number of transverse flows into (in the case of 1324) two separate portions of the main channel (121). Creation of a number of transverse flows in this manner mixes the fluids.

Figure 13B:
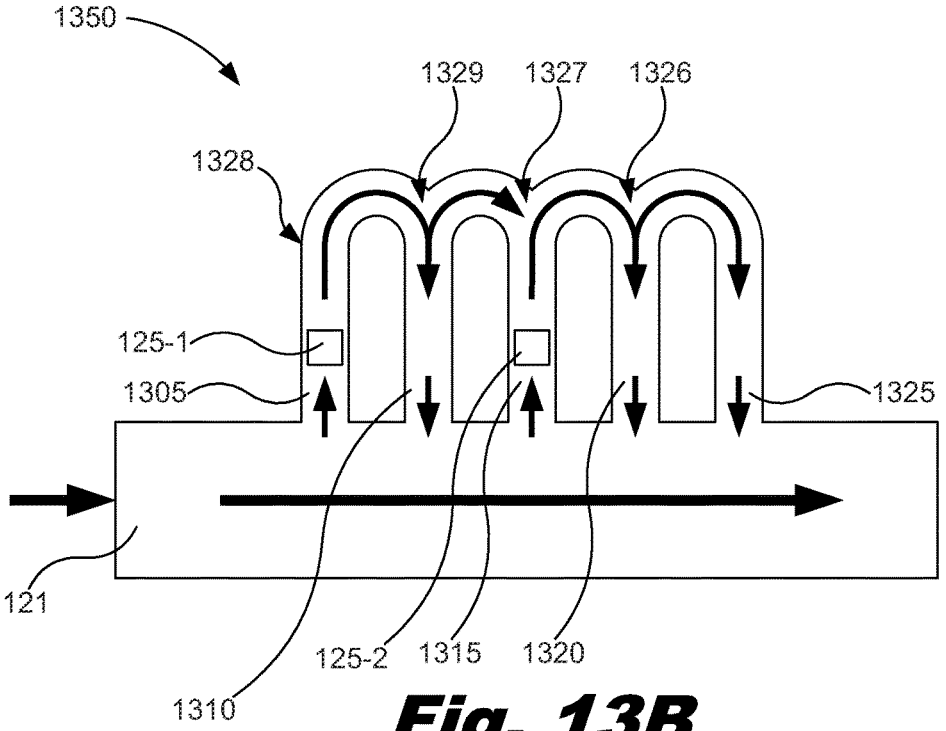
FIG. 13B is a cross-sectional diagram of a repeating M-shaped microfluidic mixing device in which the secondary channel actuators produce an M-shaped (M) flow through the microfluidic mixing device, according to one example of the principles described herein.

FIG. 13B is a cross-sectional diagram of a repeating M-shaped microfluidic mixing device (1350) in which the secondary channel actuators produce an M-shaped (M) flow through the microfluidic mixing device, according to one example of the principles described herein. Fluid may flow from the main channel (121) into the repeating M-shaped channel (1328) via any number of legs (1305, 1310, 1315, 1320, 1325) dependant upon the direction at which a number of actuators (125-1, 125-2) are designed to pump fluids. In the example of FIG. 13B, the fluid may flow from the main channel (121) into the repeating M-shaped channel (1328) via the first (1305) and third (1315) legs. The fluid may then move through the various portions of the repeating M-shaped channel (1328) and exit back into the main channel (121) via the second (1310), fourth (1320), and fifth (1325) legs.

The various movements of fluids within the repeating M-shaped channel (1328) creates a number of instances of transverse flows. For example, at divergent point (1329), the fluid may either exit to the main channel (121) via the second leg (1310), or continue to the third leg (1315). How much of the portion of fluid will exit via the second leg (1310), or continue to the third leg (1315) is dependent on the strength and frequency of activation of the actuators (125-1, 125-2). However, a number of transverse flows are created at divergent point (1329) that causes mixing of the fluids. A combination portion (1327) and a splitting portion (1326) are also created at the third (1315) and fourth (1320) legs as well. Any combination of actuators (125-1, 125-2) may be located within the repeating M-shaped channel (1328) of the microfluidic mixing device (1350) to create a desired flow there through, and such variations are contemplated by the present disclosure.

In the examples of 13A and 13B the arrows indicating flows within the secondary channels (1324, 1325, 1328) are examples only of the direction the flows may take when influenced by the secondary channel actuators (125-1, 125-2, 125-3). The secondary channel actuators (125-1, 125-2, 125-3) may, instead, cause the flow of fluids to move opposite as indicated by the flow arrows. In one example, the secondary channel actuators (125-1, 125-2, 125-3) move fluid from the short side of a U-shape channel toward a long side of the U-shape channel. In another example, the secondary channel actuators (125-1, 125-2, 125-3) move fluid from a long side of a U-shape channel toward a short side of the U-shape channel. In still another example, the secondary channel actuators (125-1, 125-2, 125-3) move fluid through the secondary channels in a combination of the above directions.

Figure 14:
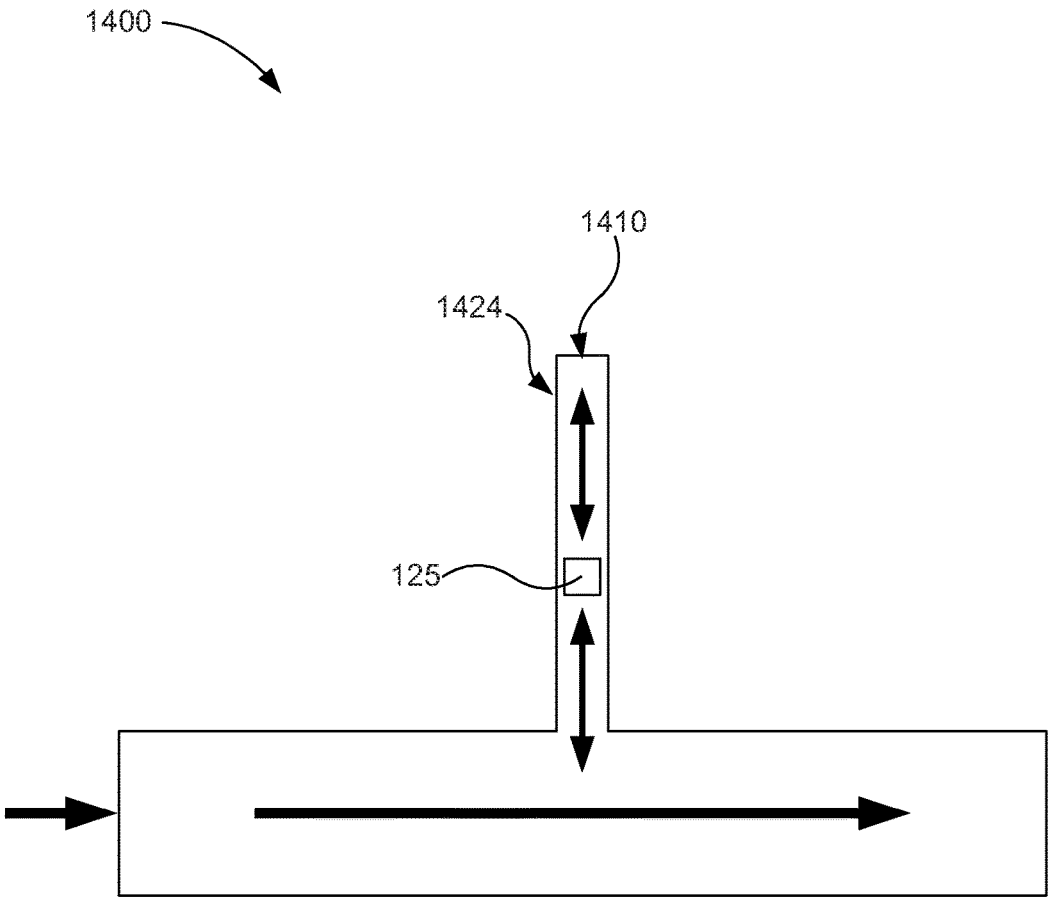
FIG. 14 is a cross-sectional diagram of an I-shaped microfluidic mixing device in which the secondary channel actuators produce a flood and drain flow through the microfluidic mixing device, according to one example of the principles described herein.

FIG. 14 is a cross-sectional diagram of an I-shaped microfluidic mixing device (1400) in which the secondary channel actuators (125) produce a flood and drain flow through the microfluidic mixing device (1400), according to one example of the principles described herein. In the example, of FIG. 14, the fluids are drawn into the I-shaped channel (1424) via the actuator (125), allowed to flood the I-shaped channel (1424) by flowing to a terminal point (1410), and drain back into the main channel (121). In one example, the actuator (125) may be a bi-directional actuator that assists in the flow of fluids in both directions. In this example, the actuator (125) may alternate between actuations that cause the fluids to ebb and flow in and out of the I-shaped channel (1424). In this manner, the fluids drawn into the I-shaped channel (1424) create a number of transverse flows within the main channel (121), and cause the fluids to mix. Any number of I-shaped channel (1424) may be fluidly coupled to the main channel (121). The number of I-shaped channel (1424) may be located along the main channel (121) in any arrangement or configuration.

Figure 15:
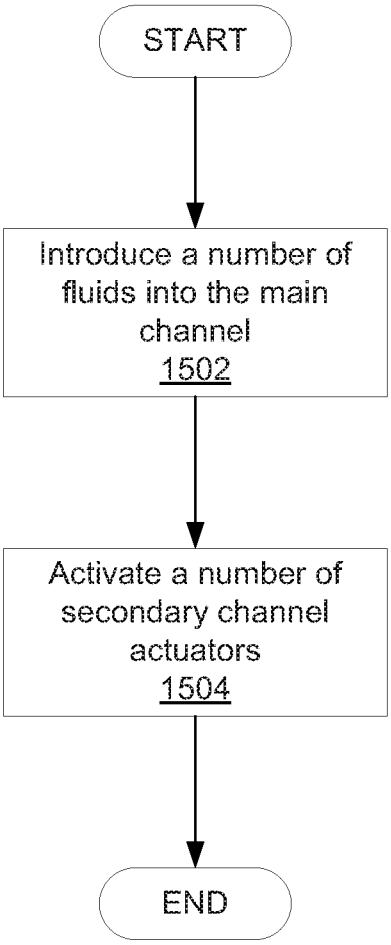
FIG. 15 is a flowchart showing a method of mixing microfluids, according to one example of the principles described herein.

FIG. 15 is a flowchart showing a method of mixing microfluids, according to one example of the principles described herein. The method of FIG. 15 may begin by introducing a number of fluids into the main channel (FIG. 1, 121) of the microfluidic mixing device (120). The control device (130) may be used to activate the external pump (FIG. 1, 111) to draw a number of fluids from the external fluid reservoirs (FIG. 1, 110), and pump them into the microfluidic mixing device (120). The processor (FIG. 1, 131) may execute the pump actuator module (FIG. 1, 136) in order to signal the external pump (FIG. 1, 111) and external fluid reservoirs (FIG. 1, 110) via electrical connection (FIG. 1, 150).

The method may continue by activating a number of secondary channel actuators (FIG. 1, 125). The control device (130) may be used to activate the actuators (125) to draw a number of fluids from the main channel (FIG. 1, 121), pump the fluids through the secondary channels (124), and reintroduce the fluids back into the main channel (FIG. 1, 121). In this manner, the secondary channels (124) and their associated (secondary channel actuators (125) create instances of displacement or transverse flows within the microfluidic mixing device (FIG. 1, 120). The processor (FIG. 1, 131) may execute the pump actuator module (FIG. 1, 136) in order to signal the secondary channel actuators (FIG. 1, 125) via electrical connection (FIG. 1, 150). Various timing and time delay methods may be used to achieve a desired movement of fluids through the secondary channels (124). In one example, the actuators (FIG. 1, 123, 125) may be activated at a number of frequencies based on a desired flow of fluids within the microfluidic mixing device (FIG. 1, 120). In one example, the actuators (FIG. 1, 123, 125) may be activated at a frequency of between 1 and 20 Hz. In another example, the actuators (FIG. 1, 123, 125) may be activated at a frequency of between 10 Hz and 10 kHz. In still another example, the actuators (FIG. 1, 123, 125) may be activated at a frequency of 50 kHz.

In one example, a number of main channel actuators (FIG. 1, 123) located within the main channel (121) in addition to the activation of the secondary channel actuators (FIG. 1, 125). In another example, the selective activation of the main channel actuators (FIG. 1, 123), the secondary channel actuators (FIG. 1, 125), or combinations thereof may be executed by the control device (130). This selective activation of the two types of actuators (FIG. 1, 123, 125) provides for the ability to toggle between active mixing and pumping modes (i.e., passive mixing).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (131) of the control device (130) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a microfluidic mixing device comprises a main channel and a number of secondary channels extending from a portion of the main channel and entering another portion of the main channel. A number of actuators are located in the secondary channels to pump fluids through the secondary channels. A microfluidic mixing system comprises a microfluidic mixing device. The microfluidic mixing device comprises a main fluid mixing channel, a number of main channel actuators to pump fluid through the main fluid mixing channel, a number of secondary channels fluidly coupled to the main fluid mixing channel, and a number of secondary channel actuators to pump fluids through the secondary channels. The microfluidic mixing device also comprises a fluid source, and a control device to provide fluids from the fluid source to the microfluidic mixing device and activate the main channel actuators and secondary channel actuators. The microfluidic mixing system and device may have a number of advantages, including (1) providing active, non-diffusive mixing; (2) providing a mixing efficiency greater than a 100 times per channel width compared to other mixing devices; (3) creating a small pressure drop across microfluidic mixer; (4) creating a system with a relatively shorter mixing channel; (5) providing for a small dead volume left within the mixing device after mixing; (6) providing for a microfluidic mixing device that is easy to fabricate; (7) providing a microfluidic mixing device that may be integrated with other components; (7) reduced pressure losses because of simplified geometry; and (8) providing for the ability to toggle between active mixing and pumping modes (passive mixing).

The preceding description has been presented to illustrate and describe examples of the principles described. This description is not intended to be exhaustive or to limit these principles to any precise form disclosed. Many modifications and variations are possible in light of the above teaching.

What is claimed is:

1. A microfluidic mixing device comprising:
a main channel;
a number of secondary channels extending from the main channel; and
a number of actuators located in the secondary channels to pump fluids within the secondary channels,
wherein at least one of the secondary channels comprises a number of I-shaped secondary channels, and
wherein a number of the actuators located within the I-shaped secondary channels are configured to produce a flood and drain flow into and out of the I-shaped secondary channels and are configured to create a number of transverse flows within the main channel.

2. The microfluidic mixing device of claim 1, wherein at least two I-shaped secondary channels extend from the main channel.

3. The microfluidic mixing device of claim 2, wherein the at least two I-shaped secondary channels extend from the main channel on a common side of the main channel.

4. The microfluidic mixing device of claim 2, wherein the at least two I-shaped secondary channels extend from the main channel on opposite sides from one another with respect to a longitudinal axis of the main channel.

5. The microfluidic mixing device of claim 3, wherein the at least two I-shaped secondary channels are located offset from each other on the opposite sides of the main channel.

6. The microfluidic mixing device of claim 1, wherein the actuators are located axis-asymmetrically within the I-shaped secondary channels to cause fluid displacements that mix the fluids as they flow into and out of the I-shaped secondary channels.

7. The microfluidic mixing device of claim 1, comprising a main channel actuator located in the main channel to cause a unidirectional fluid flow through the main channel.

8. The microfluidic mixing device of claim 1, wherein the actuators comprise an inertial pump.

9. A microfluidic mixing system comprising:
a main fluid mixing channel;
a number of I-shaped secondary channels extending from the main channel; and
a number of actuators located in the secondary channels to pump fluids within the secondary channels,
wherein at least one of the secondary channels comprises a number of I-shaped secondary channels, and
wherein the I-shaped secondary channels are configured to produce a flood and drain flow into and out of the I-shaped secondary channels and are configured to create a number of transverse flows within the main channel.

10. The microfluidic mixing system of claim 9, wherein the actuators are located axis-asymmetrically within the I-shaped secondary channels to cause fluid displacements that mix the fluids as they flow into and out of the I-shaped secondary channels.

11. The microfluidic mixing system of claim 9, comprising a main channel actuator located in the main channel to cause a unidirectional fluid flow through the main channel.

12. The microfluidic mixing system of claim 9, comprising:
a fluid source; and
a control device to:
provide fluids from the fluid source to the microfluidic mixing device; and
activate the main channel actuators and secondary channel actuators.

13. The microfluidic mixing system of claim 9, comprising:
a fluid inlet chamber to pass fluids into the main fluid mixing channel of the microfluidic mixing device; and
a fluid outlet chamber to receive the mixed fluids from the main fluid mixing channel of the microfluidic mixing device.

14. The microfluidic mixing system of claim 11, wherein the secondary channel actuators and main channel actuators comprise thermal resistors, piezo elements, deflective membrane elements activated by electrical forces, deflective membrane elements activated by magnetic forces, deflective membrane elements activated by mechanical forces, a mechanical transducer, an acoustic transducer, an ultrasonic transducer, a dielectrophoretic transducer, an electrokinetic timepulse transducer, a pressure perturbation transducer, magnetic transducers, or a combination thereof.

15. The microfluidic mixing system of claim 12, wherein the control device controls the sequence and timing of activation of the actuators within the I-shaped secondary channels.

16. The microfluidic mixing device of claim 1, further comprising:
a non-transitory computer readable storage medium comprising computer usable program code embodied therewith, and a processor to execute the program code to:
activate a number of the secondary channel actuators to pump fluids through the secondary channels.

17. The microfluidic mixing device of claim 16, comprising computer usable program code to, when executed by the processor, receive data from a host device, the data representing executable instructions to be executed by the processor to control the activation of a number of main channel actuators and the secondary channel actuators.

18. The microfluidic mixing device of claim 16, wherein the actuators located within the I-shaped secondary channels are bi-directional actuators, and wherein the computer program product comprises computer usable program code to, when executed by the processor, activate the bi-directional actuators to pump fluid in a first direction to flood the I-shaped secondary channels and activate the actuators located within the I-shaped secondary channels to pump fluid in a second direction to drain the I-shaped secondary channels.

19. The microfluidic mixing device of claim 16, wherein at least two I-shaped secondary channels extend from the main channel and wherein the computer program product comprises computer usable program code to, when executed by the processor, activate the actuators within a first I-shaped secondary channels at a different time respect to second I-shaped secondary channel.

20. The microfluidic mixing device of claim 16, comprising computer usable program code to, when executed by the processor, activate a fluid source to introduce a number of fluids into the main channel of a microfluidic mixing device.

* * * * *